US009886963B2

(12) United States Patent
Atti et al.

(10) Patent No.: US 9,886,963 B2
(45) Date of Patent: Feb. 6, 2018

(54) ENCODER SELECTION

(71) Applicant: QUALCOMM Incorporated, San Diego, CA (US)

(72) Inventors: Venkatraman S. Atti, San Diego, CA (US); Venkata Subrahmanyam Chandra Sekhar Chebiyyam, San Diego, CA (US); Vivek Rajendran, San Diego, CA (US); Subasingha Shaminda Subasingha, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 9 days.

(21) Appl. No.: 15/083,867

(22) Filed: Mar. 29, 2016

(65) Prior Publication Data

US 2016/0293175 A1 Oct. 6, 2016

Related U.S. Application Data

(60) Provisional application No. 62/143,155, filed on Apr. 5, 2015.

(51) Int. Cl.

| | |
|---|---|
| ***G10L 19/00*** | (2013.01) |
| ***G10L 19/22*** | (2013.01) |
| ***G10L 19/12*** | (2013.01) |
| ***G10L 19/087*** | (2013.01) |
| ***G10L 25/87*** | (2013.01) |

(Continued)

(52) U.S. Cl.

CPC ..... *G10L 19/22* (2013.01); *G10L 19/087* (2013.01); *G10L 19/12* (2013.01); *G10L 19/20* (2013.01); *G10L 25/87* (2013.01); *G10L 25/27* (2013.01)

(58) Field of Classification Search

USPC ..... 704/208, 214, 219, 500–504

See application file for complete search history.

(56) References Cited

U.S. PATENT DOCUMENTS 6,983,242 B1 * 1/2006 Thyssen ..... G10L 19/22 704/208

2002/0111798 A1 8/2002 Huang (Continued)

FOREIGN PATENT DOCUMENTS

EP 1808852 A1 7/2007

OTHER PUBLICATIONS

International Search Report and Written Opinion—PCT/US2016/025049—ISA/EPO—Jul. 4, 2016, 12 pages.

*Primary Examiner* — Leonard Saint Cyr

(74) *Attorney, Agent, or Firm* — Toler Law Group, P.C.

(57) ABSTRACT

A device includes a first classifier and a second classifier coupled to the first classifier. The first classifier is configured to output first decision data that indicates a classification of an audio frame as a speech frame or a non-speech frame, the first decision data determined based on first probability data associated with a first likelihood of the audio frame being the speech frame and based on second probability data associated with a second likelihood of the audio frame being the non-speech frame. The second classifier is configured to output second decision data based on the first probability data, the second probability data, and the first decision data, the second decision data includes an indication of a selection of a particular encoder of multiple encoders available to encode the audio frame.

47 Claims, 7 Drawing Sheets

(51) Int. Cl.
*G10L 19/20* (2013.01)
*G10L 25/27* (2013.01)

(56) References Cited

U.S. PATENT DOCUMENTS

2003/0101049 A1* 5/2003 Lakaniemi ..... G10L 19/018
704/214
2003/0101050 A1* 5/2003 Khalil ..... G10L 25/81
704/216
2008/0147414 A1* 6/2008 Son ..... G10L 19/20
704/500
2008/0162121 A1* 7/2008 Son ..... G10L 19/22
704/201
2011/0010168 A1* 1/2011 Yu ..... G10L 19/093
704/219
2011/0016077 A1* 1/2011 Vasilache ..... G10L 25/78
706/52
2011/0202337 A1 8/2011 Fuchs et al.
2013/0185063 A1* 7/2013 Atti ..... G10L 17/02
704/219
2014/0188465 A1* 7/2014 Choo ..... G10L 19/12
704/219

* cited by examiner

ENCODER SELECTION

I. CROSS REFERENCE TO RELATED APPLICATIONS

The present application claims the benefit of U.S. Provisional Patent Application No. 62/143,155, entitled "ENCODER SELECTION," filed Apr. 5, 2015, which is expressly incorporated by reference herein in its entirety.

II. FIELD

The present disclosure is generally related to selection of an encoder.

III. DESCRIPTION OF RELATED ART

Recording and transmission of audio by digital techniques is widespread. For example, audio may be transmitted in long distance and digital radio telephone applications. Devices, such as wireless telephones, may send and receive signals representative of human voice (e.g., speech) and non-speech (e.g., music or other sounds).

In some devices, multiple coding technologies are available. For example, an audio coder-decoder (CODEC) of a device may use a switched coding approach to encode a variety of content. To illustrate, the device may include a speech encoder, such as an algebraic code-excited linear prediction (ACELP) encoder, and a non-speech encoder, such as a transform coded excitation (TCX) encoder (e.g., a transform domain encoder). The speech encoder may be proficient at encoding speech content and the non-speech encoder, such as a music encoder, may be proficient at encoding inactive and music content. It should be noted that, as used herein, an "encoder" could refer to one of the encoding modes of a switched encoder. For example, the ACELP encoder and the TCX encoder could be two separate encoding modes within a switched encoder.

The device may use one of multiple approaches to classify an audio frame and to select an encoder. For example, an audio frame may be classified as a speech frame or as a non-speech frame (e.g., a music frame). If the audio frame is classified as a speech frame, the device may select the speech encoder to encode the audio frame. Alternatively, if the audio frame is classified as a non-speech frame (e.g., the music frame), the device may select the non-speech encoder to encode the audio frame.

A first approach that may be used by the device to classify the audio frame may include a Gaussian mixture model (GMM) that is based on speech characteristics. For example, the GMM may use speech characteristics, such as pitch, spectral shape, a correlation metric, etc., of the audio frame to determine whether the audio frame is more likely a speech frame or more likely a non-speech frame. The GMM may be proficient at identifying speech frames, but may not work as well to identify non-speech frames (e.g., music frames).

A second approach may include an open-loop classifier. The open-loop classifier may predict which encoder (e.g., the speech encoder or the non-speech encoder) is more suitable to encode an audio frame. The term "open-loop" is used to signify that the audio frame is not explicitly encoded prior to predicting which encoder to select. The open-loop classifier may be proficient at identifying non-speech frames, but may not work as well to identify speech frames.

A third approach that may be used by the device to classify the audio frame may include a model based classifier and an open-loop classifier. The model based classifier may output a decision to the open-loop classifier, which may use the decision in classifying the audio frame.

The device may analyze an incoming audio signal on a frame-by-frame basis and may decide whether to encode a particular audio frame using the speech encoder or the non-speech encoder, such as a music encoder. If the particular audio frame is misclassified (e.g., is improperly classified as a speech frame or as a non-speech frame), artifacts, poor signal quality, or a combination thereof, may be produced.

IV. SUMMARY

In a particular aspect, a device includes a first classifier and a second classifier coupled to the first classifier. The first classifier is configured to determine first decision data that indicates a classification of an audio frame as a speech frame or a non-speech frame. The first decision data is determined based on first probability data associated with a first likelihood of the audio frame being the speech frame and based on second probability data associated with a second likelihood of the audio frame being the non-speech frame. The second classifier is configured to determine second decision data based on the first probability data, the second probability data, and the first decision data. The second decision data includes an indication of a selection of a particular encoder of multiple encoders available to encode the audio frame.

In another particular aspect, a method includes receiving, from a first classifier, first probability data and second probability data at a second classifier. The first probability data is associated with a first likelihood of an audio frame being a speech frame and the second probability data is associated with a second likelihood of the audio frame being a non-speech frame. The method also includes receiving first decision data from the first classifier at the second classifier. The first decision data based on the first probability data and the second probability data. The first decision data indicates a classification of the audio frame as the speech frame or the non-speech frame. The method further includes determining, at the second classifier, second decision data based on the first probability data, the second probability data, and the first decision data. The second decision data indicates a selection of a particular encoder of multiple encoders to encode the audio frame.

In another particular aspect, an apparatus includes means for determining first probability data associated with a first likelihood of an audio frame being a speech frame and means for determining second probability data associated with a second likelihood of the audio frame being a non-speech frame. The apparatus also includes means for determining first decision data based on the first probability data and the second probability data. The first decision data includes a first indication of a classification of the audio frame as the speech frame or the non-speech frame. The apparatus further includes means for determining second decision data based on the first probability data, the second probability data, and the first decision data. The second decision data include a second indication of a selection of an encoder to encode the audio frame.

In another particular aspect, a computer-readable storage device storing instructions that, when executed by a processor, cause the processor to perform including determining first probability data associated with a first likelihood of an audio frame being a speech frame and determining second probability data associated with a second likelihood of the audio frame being a non-speech frame. The operations also include determining first decision data based on the first probability data and the second probability data. The first decision data indicates a classification of the audio frame as the speech frame or the non-speech frame. The operations further include determining second decision data based on the first probability data, the second probability data, and the first decision data. The second decision data indicates a selection of an encoder to encode the audio frame.

In another particular aspect, a method includes receiving first probability data and first decision data from a first classifier at a second classifier. The first probability data is associated with a first likelihood of an audio frame being a speech frame. The first decision data indicates a classification of the audio frame as the speech frame or a non-speech frame. The method also includes determining, at the second classifier, whether a set of conditions associated with the audio frame is satisfied. A first condition of the set of conditions is based on the first probability data and a second condition of the set of conditions is based on the first decision data. The method further includes, responsive to determining whether the set of conditions is satisfied, selecting a value of an adjustment parameter to bias a selection towards a first encoder of multiple encoders.

Other aspects, advantages, and features of the present disclosure will become apparent after review of the application, including the following sections: Brief Description of the Drawings, Detailed Description, and the Claims.

V. BRIEF DESCRIPTION OF THE DRAWINGS

VI. DETAILED DESCRIPTION

Figure 1:
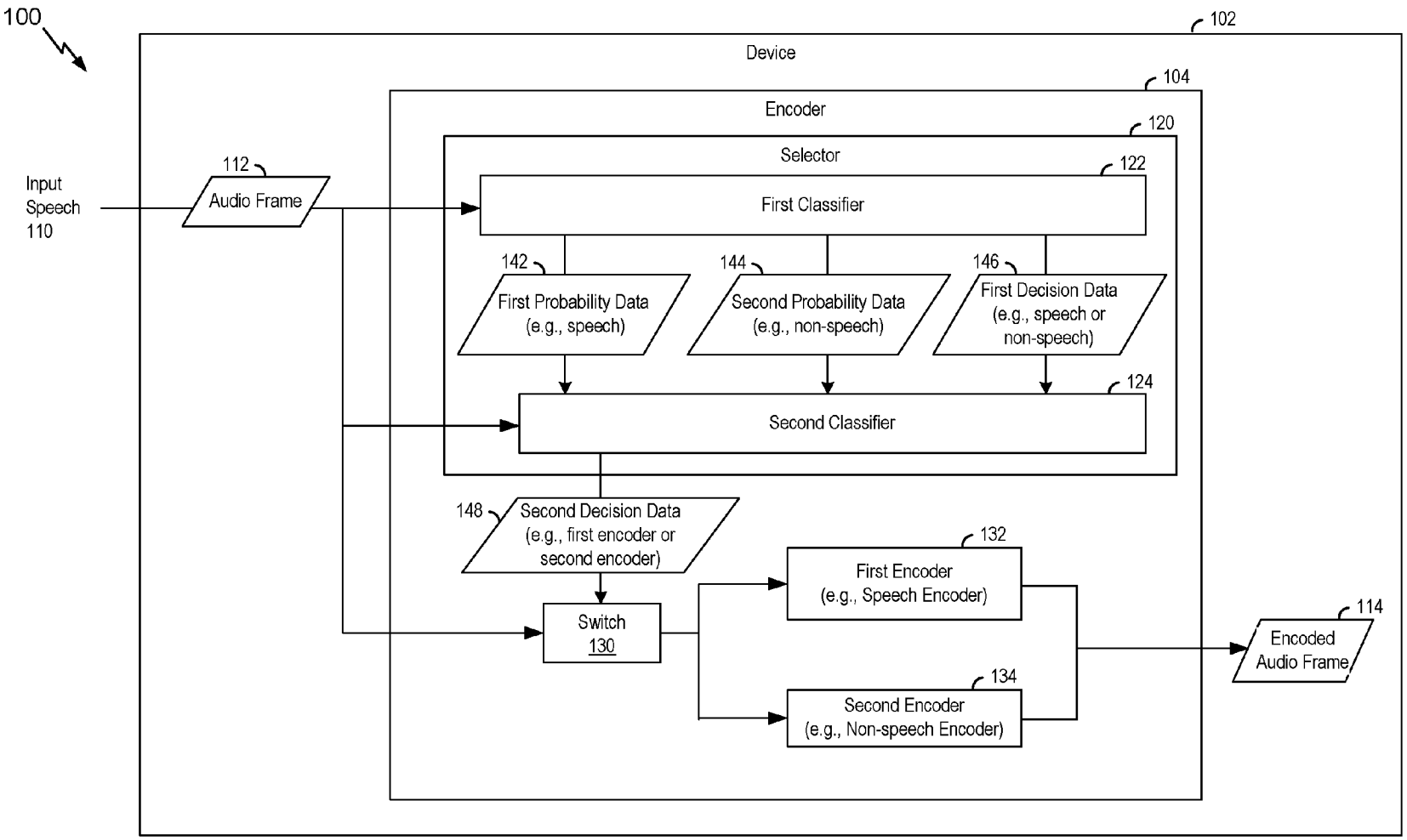
FIG. 1 is a block diagram of a particular illustrative aspect of a system that is operable to select an encoder.

Particular aspects of the present disclosure are described below with reference to the drawings. In the description, common features are designated by common reference numbers. As used herein, various terminology is used for the purpose of describing particular implementations only and is not intended to be limiting. For example, the singular forms "a," "an," and "the" are intended to include the plural forms as well, unless the context clearly indicates otherwise. It may be further understood that the terms "comprises" and "comprising" may be used interchangeably with "includes" or "including." Additionally, it will be understood that the term "wherein" may be used interchangeably with "where." As used herein, an ordinal term (e.g., "first," "second," "third," etc.) used to modify an element, such as a structure, a component, an operation, etc., does not by itself indicate any priority or order of the element with respect to another element, but rather merely distinguishes the element from another element having a same name (but for use of the ordinal term). As used herein, the term "set" refers to a grouping of one or more elements, and the term "plurality" refers to multiple elements.

In the present disclosure, techniques to select an encoder or an encoding mode are described. A device may receive an audio frame and may select a particular encoder of multiple encoders (or encoding modes) to be used to encode the audio frame. The techniques described herein may be used to set a value of an adjustment parameter (e.g., a hysteresis metric) that is used to bias a selection toward a particular encoder (e.g., a speech encoder or a non-speech/music encoder) or a particular encoding mode. The adjustment parameter may be used to provide a more accurate classification of the audio frame, which may result in improved selection of an encoder to be used to encode the audio frame.

To illustrate, the device may receive an audio frame and may use multiple classifiers, such as a first classifier and a second classifier, to identify an encoder to be selected to encode the audio frame. The first classifier may generate first decision data based on a speech model (e.g., speech model circuitry), based a non-speech model (e.g., non-speech model circuitry), or a combination thereof. The first decision data may indicate whether the audio frame is a speech-like frame or a non-speech (e.g., music, background noise, etc.) frame. Speech content may be designated as including active speech, inactive speech, noisy speech, or a combination thereof, as illustrative, non-limiting examples. Non-speech content may be designated as including music content, music like content (e.g., music on hold, ring tones, etc.), background noise, or a combination thereof, as illustrative, non-limiting examples. In other implementations, inactive speech, noisy speech, or a combination thereof, may be classified as non-speech content by the device if a particular encoder associated with speech (e.g., a speech encoder) has a difficulty decoding inactive speech or noisy speech. In another implementation, background noise may be classified as speech content. For example, the device may classify background noise as speech content if a particular encoder associated with speech (e.g., a speech encoder) is proficient at decoding background noise.

In some implementations, the first classifier may be associated with a maximum-likelihood algorithm (e.g., based on Gaussian mixture models, based on hidden Markov models, or based on neural networks). To generate the first decision data, the first classifier may generate one or more probability values, such as a first probability value (e.g., first probability data) associated with a first likelihood of the audio frame being the speech frame, a second probability value (e.g., second probability data), associated with a second likelihood of the audio frame being the non-speech frame, or a combination thereof. The first classifier may include a state machine that receives the first probability data, the second probability data, or a combination thereof, and that generates the first decision data. The first decision data may be output by the state machine and received by the second classifier.

The second classifier may be configured to generate second decision data associated with (e.g., that indicates) a selection of a particular encoder of multiple encoders to encode the audio frame. The second decision data may correspond to an updated or modified classification of the audio frame (e.g., the second decision data may indicate a different classification from the first decision data). In some implementations, the first decision data may indicate the same classification as the second decision data. Additionally or alternatively, the second decision data may correspond to a "final decision" (e.g., if the audio frame has a classification of a speech frame, the speech encoder is selected). The second classifier may be a model based classifier, may be a classifier not purely based on model (e.g., an open-loop classifier), or may be based on a set of coding parameters. The coding parameters may include a core indicator, a coding mode, a coder type, a low pass core decision, a pitch value, a pitch stability, or a combination thereof, as illustrative, non-limiting examples.

The second classifier may generate the second decision data based on the first decision data, the first probability data, the second probability data, or a combination thereof. In some implementations, the second classifier may use one or more of the set of coding parameters to generate the second decision data. Additionally, the second classifier may generate the second decision data based on one or more conditions associated with the audio frame. For example, the second classifier may determine whether a set of conditions associated with the audio frame are satisfied, as described herein. In response to one or more conditions of the set of conditions being satisfied (or not satisfied), the second classifier may determine a value of an adjustment parameter to bias (e.g., influence) a selection toward a first encoder (e.g., the speech encoder) or a second encoder (e.g., the non-speech encoder). In other implementations, the second classifier may determine a value of an adjustment parameter to bias (e.g., influence) a selection toward a particular encoding mode of a switchable encoder that has multiple encoding modes, such a switched encoder. The adjustment parameter may operate as a hysteresis metric (e.g., a time-based metric) that may be used by the second classifier to improve selection of an encoder for the audio frame. For example, the hysteresis metric may "smooth" an encoded audio stream that includes the encoded audio frame by delaying or reducing switching back and forth between two encoders until a threshold number of sequential audio frames have been identified as having a particular classification.

The set of conditions may include a first condition that at least one of the encoders is associated with a first sample rate (e.g., an audio sampling rate). In some implementations, the first sample rate may be a low audio sampling rate, such as 12.8 kilohertz (kHz), as an illustrative non-limiting example. In other implementations, the first sample rate may be greater than or less than 12.8 kHz, such as 14.4 kHz or 8 kHz. In a particular implementation, the first sample rate may be lower than other sample rates used by the encoders. The set of conditions may include a second condition that the first decision is associated with classification of the audio frame as the speech frame. The set of conditions may include a third condition that a first estimated coding gain value associated with the first encoder being used to encode the audio frame is greater than or equal to a first value, where the first value is associated with a difference between a second estimated coding gain value and a second value.

In some implementations, if a most recently classified frame is associated with speech content, the set of conditions may include a condition that is associated with a determination that the first probability value is greater than or equal to the second probability value. Alternatively, if each frame of multiple recently classified frames is associated with speech content, the set of conditions may include another condition that is associated with a determination that the first probability value is greater than or equal to a third value, where the third value is associated with a difference between the second probability value and a fourth value.

In some implementations, the set of conditions may include a condition associated with a mean voicing value of multiple sub-frames of the audio frame being greater than or equal to a first threshold. Additionally or alternatively, the set of conditions may include a condition associated with a non-stationarity value associated with the audio frame being greater than a second threshold. Additionally or alternatively, the set of conditions may include a condition associated with an offset value associated with the audio frame being less than a third threshold.

Referring to FIG. 1, a particular illustrative example of a system 100 operable to select an encoder is disclosed. The system 100 includes a device 102 configured to receive an audio signal that may include input speech 110, such as a sampled audio signal received via a microphone that is coupled to or included in the device 102. The device 102 is configured to select between a first encoder 132 and a second encoder 134 to encode all or part of the input speech 110. Although the first encoder 132 and the second encoder 134 are illustrated as separate encoders, in other implementations, the first encoder 132 and the second encoder 134 may be included in a single encoder (e.g. a switched encoder). For example, the first encoder 132 and the second encoder 134 may correspond to different encoding modes of a switched encoder. Encoding the input speech 110 may generate of a series of encoded audio frames, such as an encoded audio frame 114, that may be sent to one or more other devices, such as a via a wireless network. For example, the device 102 may be engaged in a voice call, such as a voice over Internet protocol (VoIP) call, with a remote device. In some implementations, the first encoder 132, the second encoder 134, or both may be configured to operate in accordance with one or more protocols/standards, such as in accordance (e.g. compliance) with a 3rd Generation Partnership Project (3GPP) enhanced voice services (EVS) protocol/standard, as an illustrative, non-limiting example.

The device 102 includes an encoder 104 that includes a selector 120, a switch 130, and multiple encoders including the first encoder 132 and the second encoder 134. The encoder 104 is configured to receive audio frames of the audio signal that includes the input speech 110, such as an audio frame 112. The audio signal may include speech data, non-speech data (e.g., music or background noise), or both. The selector 120 may be configured to determine whether each frame of the audio signal is to be encoded by the first encoder 132 or the second encoder 134. For example, the first encoder 132 may include a speech encoder, such as an ACELP encoder, and the second encoder 134 may include a non-speech encoder, such as a music encoder. In a particular implementation, the second encoder 134 includes a TCX encoder. The switch 130 is responsive to the selector 120 to route the audio frame 112 to a selected one of the first encoder 132 or the second encoder 134 to generate the encoded audio frame 114.

The selector 120 may include a first classifier 122 and a second classifier 124. The first classifier 122 may be configured to receive the audio frame 112 or a portion of the audio frame 112, such as a feature-set described with reference to FIGS. 2 and 3. The first classifier 122 may be configured to output first decision data 146 that indicates a classification of the audio frame 112 as a speech frame or a non-speech frame. The first decision data 146 may be determined based on first probability data 142 associated with a first likelihood of the audio frame being a speech frame and based on second probability data 144 associated with a second likelihood of the audio frame being a non-speech frame. For example, the first classifier 122 may include or correspond to a model based classifier, a GMM circuit (e.g., a GMM module), or both. A particular implementation of the first classifier 122 is described in further detail with respect to FIG. 3.

The second classifier 124 is coupled to the first classifier 122 and configured to output second decision data 148 based on the first probability data 142, the second probability data 144, and the first decision data 146. The second decision data 148 indicates a selection of a particular encoder of multiple encoders (e.g., the first encoder 132 or the second encoder 134) that is available to encode the audio frame 112. In some implementations, the second classifier 124 may be configured to receive the audio frame 112. The second classifier 124 may receive the audio frame 112 from the first classifier 122, from the encoder 104, or from another component of the device 102. Additionally or alternatively, the second classifier 124 may be configured to generate an adjustment parameter. A value of the adjustment parameter may bias (e.g., influence) the second decision data 148 towards indicating a particular encoder of multiple encoders (e.g., the first encoder 132 or the second encoder 134). For example, a first value of the adjustment parameter may increase a probability of selecting the particular encoder. The second classifier 124 may include or correspond to an open-loop classifier. A particular implementation of the second classifier 124 is described in further detail with respect to FIG. 4.

The switch 130 is coupled to the selector 120 and may be configured to receive the second decision data 148. The switch 130 may be configured to select the first encoder 132 or the second encoder 134 according to the second decision data 148. The switch 130 may be configured to provide the audio frame 112 to the first encoder 132 or the second encoder 134 according to (e.g., based on) the second decision data 148. In other implementations, the switch 130 provides or routes a signal to a selected encoder to activate or enable an output of the selected encoder.

The first encoder 132 and the second encoder 134 may be coupled to the switch 130 and configured to receive the audio frame 112 from the switch 130. In other implementations, first encoder 132 or the second encoder 134 may be configured to receive the audio frame 112 from another component of the device 102. The first encoder 132 and the second encoder 134 may be configured to generate the encoded audio frame 114 in response to receiving the audio frame 112.

During operation, the input speech 110 may be processed on a frame-by-frame basis, and a set of features may be extracted from the input speech 110 at the encoder 104 (e.g., in the selector 120). The set of features may be used by the first classifier 122. For example, the first classifier 122 (e.g., a model based classifier) may generate and output the first probability data 142 and the second probability data 144, such as a short-term probability of speech ("lps") and a short-term probability of music ("lpm"), respectively. As described with respect to FIG. 3, the lps and lpm values corresponding to a particular frame may be provided to a state machine in the first classifier 122 that keeps track of one or more states (e.g., state parameters) of the encoder 104 to generate a decision of speech or music ("sp_aud_decision") for the particular frame. The one or more states of the encoder 104 may include values of long-term parameters, such as a count of inactive frames, a count of speech frames, a count of music frames, etc. The state machine may also receive parameters such as a voice activity decision from a voice activity detector (VAD), an energy of a current frame, etc. Although the VAD is described as a "voice" activity detector, it should be understood that the VAD is a discriminator between an active signal (which might include speech or music) and an inactive signal, such as background noise.

The second classifier 124 may use short-term features extracted from the frame to estimate two coding gain estimates or measures, referred to as a signal-to-noise ratio for ACELP encoding ("snr_acelp") and a signal-to-noise ratio for TCX encoding ("snr_tcx"). Although referred to as SNR ratios, snr_acelp and snr_tcx may be coding gain estimates or other estimates or measures that may correspond to the likelihood of a current frame being speech or music, respectively, or that may correspond to an estimated degree of effectiveness of the first encoder 132 (e.g., an ACELP encoder) or the second encoder 134 (e.g., a TCX encoder) in encoding the frame. The second classifier 124 may modify (e.g., adjust a value of) snr_acelp, snr_tcx, or both, based on long-term information, such as first decision data 146 (e.g., "sp_aud_decision"), and further based on additional data from the first classifier 122, such as the first probability data 142 (e.g., "lps"), the second probability data 144 (e.g., "lpm"), one or more other parameters, or a combination thereof.

Figure 2:
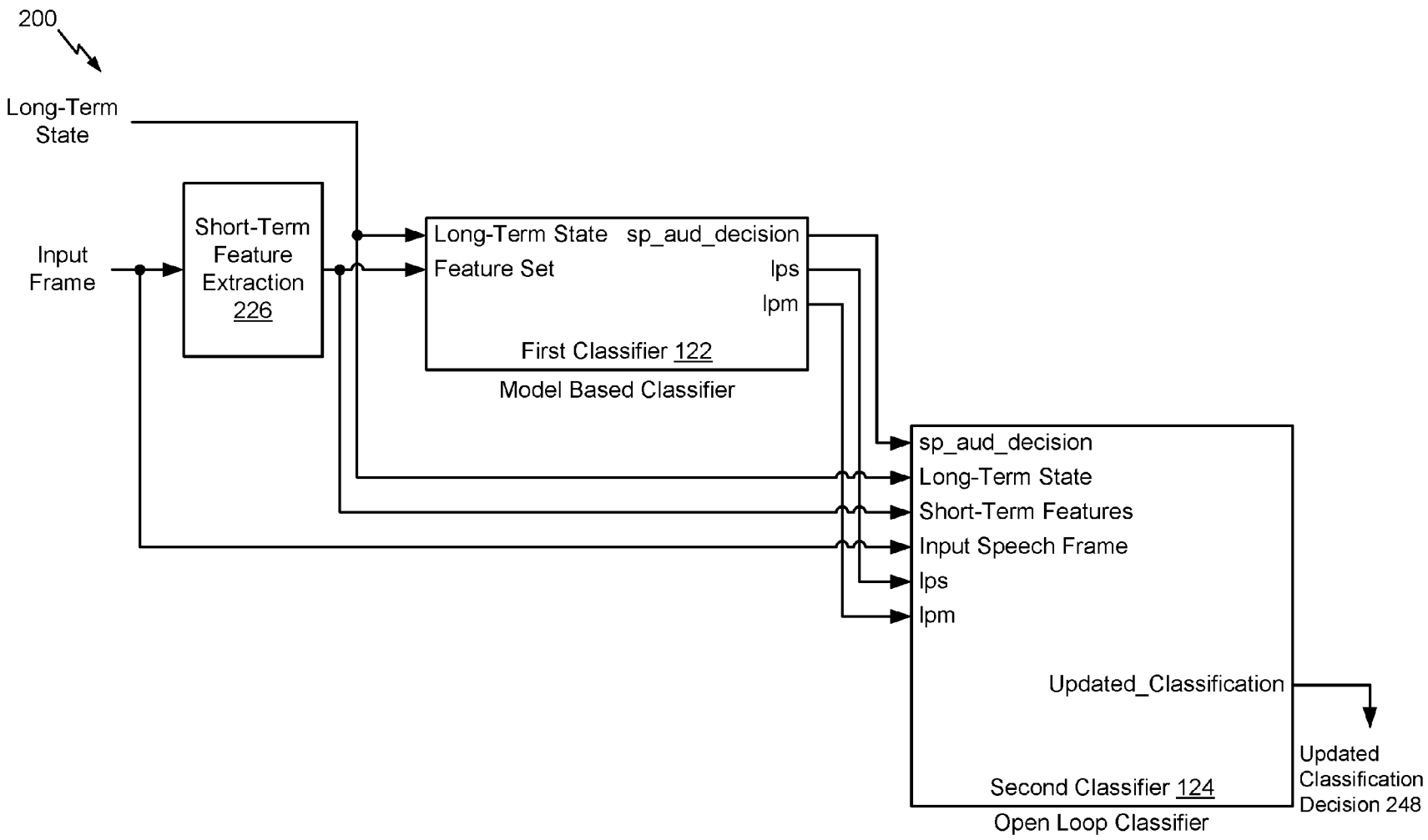
FIG. 2 is a block diagram of a particular illustrative aspect of a selector of the system of FIG. 1.

The selector 120 may therefore bias (e.g., influence) the decision of which encoder (e.g., the first encoder 132 or the second encoder 134) to apply to a particular frame based on long-term and short-term parameters that may be generated at either of the classifiers 122, 124 and as shown in FIG. 2. By selecting an encoder based on additional data (e.g., the first probability data 142, the second probability data 144, or both) from the first classifier 122, the selector 120 may reduce a number of false positives and a number of missed detections for selecting frames to be encoded by either the first encoder 132 or the second encoder 134 as compared to an implementation that uses a decision from a first classifier (e.g., a model-based classifier or an open-loop classifier) to select either the first encoder 132 or the second encoder 134 for each frame.

In addition, it should be noted that although FIG. 1 illustrates the first encoder 132 and the second encoder 134, this is not to be considered limiting. In alternate examples, more than two encoders, circuits, or other modules may be included. For example, the encoder 104 can include one or more low band (LB) "core" circuits or modules (e.g., a TCX core, an ACELP core, one or more other cores, or any combination thereof) and one or more high band (HB)/bandwidth extension (BWE) circuits or modules. A low band portion of an audio frame 112 selected for speech encoding may be provided to a particular low band core circuit or module for encoding, depending on characteristics of the frame (e.g., whether the frame contains speech, noise, music, etc.). The high band portion of each frame may be provided to a particular HB/BWE circuit or module.

FIG. 2 is a block diagram of a particular illustrative example 200 of the selector 120 of FIG. 1. In the example 200, the selector 120 is configured to receive an input frame (e.g., the audio frame 112 of FIG. 1) and data corresponding to a long-term state of the encoder 104 and to output speech/music decision (e.g., the first decision data 146 of FIG. 1). A short-term feature extractor 226 is configured to receive the input frame and to generate a feature-set extracted from the input frame. To illustrate, the short-term feature extractor 226 may be configured to generate short-term features based on the input frame.

The first classifier 122 is depicted as a model-based classifier that is configured to receive the feature-set from the short-term feature extractor 226 and the long-term state data. The first classifier 122 is configured to generate an indicator of a short-term probability of speech ("lps") (e.g., the first probability data 142 of FIG. 1), an indicator of a short-term probability of music ("lpm") (e.g., the second probability data 144 of FIG. 1), and the speech/music decision ("sp_aud_decision") (e.g., the first decision data 146 of FIG. 1). In some implementations, the first classifier 122 may be configured to receive the input frame.

The second classifier 124 is depicted as an open-loop classifier that is configured to receive the input frame and the long-term state data. The second classifier 124 may also be configured to receive the short-term features from the short-term feature extractor 226 and to receive the indicator of a short-term probability of speech ("lps"), the indicator of a short-term probability of music ("lpm"), and the speech/music decision ("sp_aud_decision") from the first classifier 122. The second classifier 124 is configured to output an updated (or modified) classification decision (e.g., the second decision data 148 of FIG. 1). The second classifier 124 may output the second decision data to a switch (e.g., the switch 130 of FIG. 1) or a switched encoder. Additionally or alternatively, the second classifier 124 may be configured to receive the feature-set from the short-term feature extractor 226.

Figure 3:
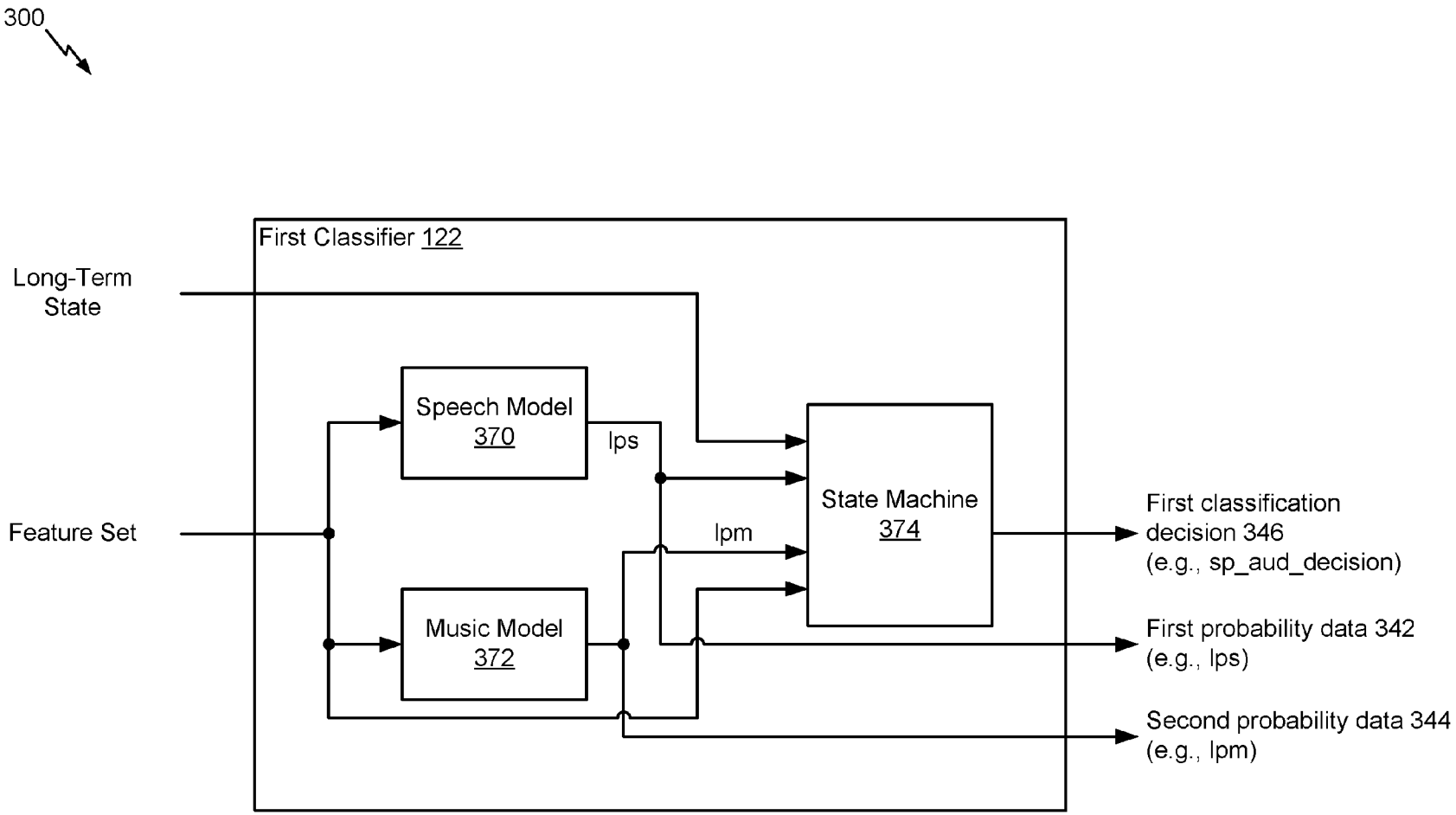
FIG. 3 is a block diagram of a particular illustrative aspect of a first classifier of the system of FIG. 1.

Details of the first classifier 122 are illustrated in accordance with a particular example 300 that is depicted in FIG. 3. In the example 300, the first classifier 122 includes a speech model 370 (e.g., speech model circuitry), a music model 372 (e.g., music model circuitry), and a state machine 374. The speech model 370 is configured to calculate the indicator of a short-term probability of speech ("lps") based on the feature-set received from the short-term feature extractor 226 of FIG. 2. The music model 372 is configured to calculate the indicator of a short-term probability of music ("lpm") based on the feature-set received from the short-term feature extractor 226. In other implementations, the first classifier 122 may receive the input frame and may determine the feature-set.

The state machine 374 may be configured to receive first probability data (e.g., the indicator of a short-term probability of speech ("lps") output from the speech model 370, corresponding to the first probability data 142 of FIG. 1). The state machine 374 may be configured to receive second probability data (e.g., the indicator of a short-term probability of music ("lpm") output from the music model 372, corresponding to the second probability data 144 of FIG. 1). The state machine 374 may be configured to generate the speech/music decision ("sp_aud_decision") (e.g., the first decision data 146 of FIG. 1) based on the first probability data and the second probability data.

Figure 4:
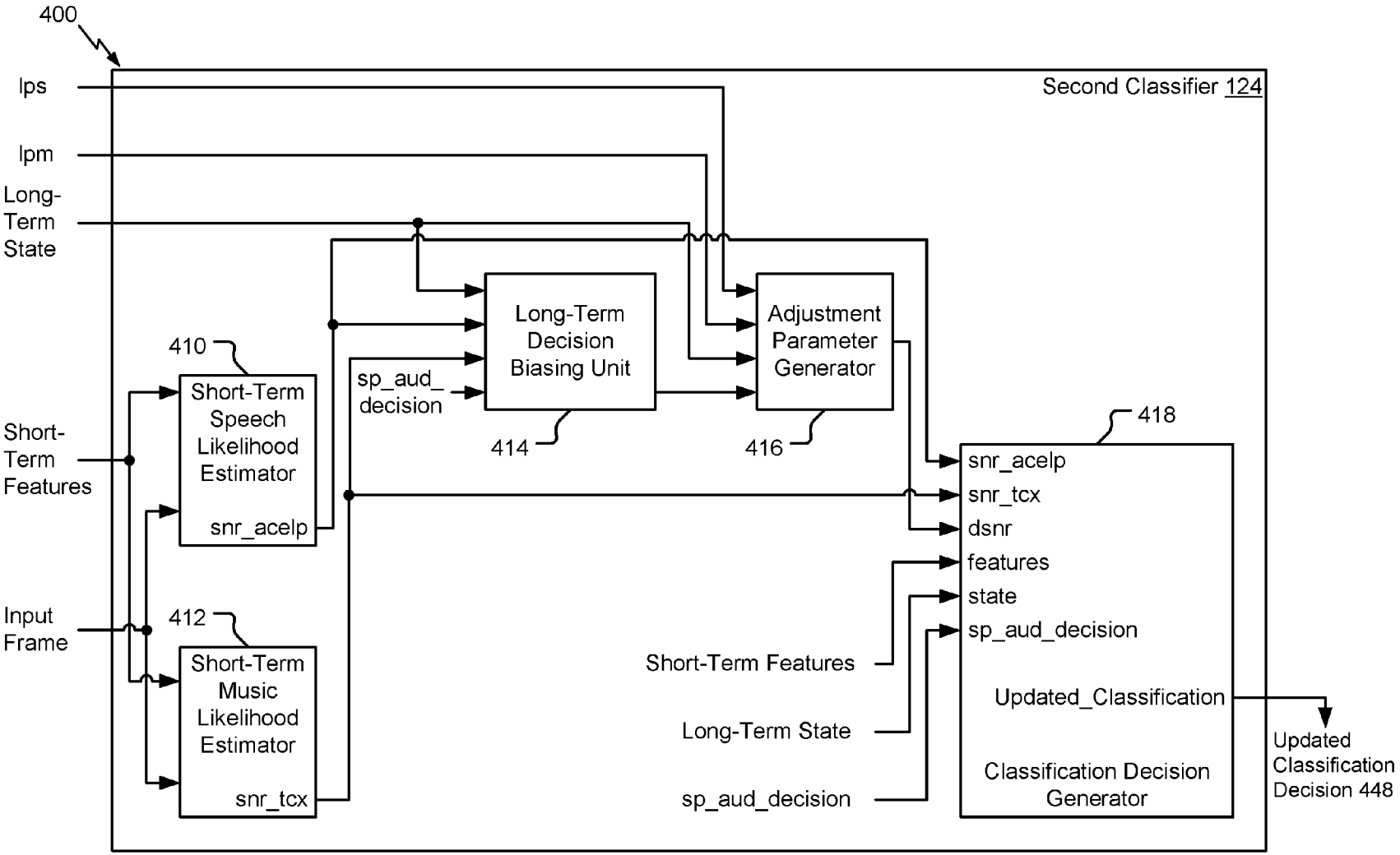
FIG. 4 is a block diagram of a particular illustrative aspect of a second classifier of the system of FIG. 1.

Details of the second classifier 124 are illustrated in accordance with a particular example 400 that is depicted in FIG. 4. In the example 400, the second classifier 124 includes a short-term speech likelihood estimator 410, a short-term music likelihood estimator 412, a long-term decision biasing unit 414, an adjustment parameter generator 416, and a classification decision generator 418.

The short-term speech likelihood estimator 410 is configured to receive the set of short-term features extracted from the input frame (e.g., from the short-term feature extractor 226 of FIG. 2) and the input frame (e.g., the audio frame 112 of FIG. 1). The short-term speech likelihood estimator 410 is configured to generate a first estimated coding gain value (e.g., "snr_acelp") corresponding to an estimated coding gain or efficiency of encoding the input frame using an ACELP encoder (e.g., the first encoder 132 of FIG. 1).

The short-term music likelihood estimator 412 is configured to receive the set of short-term features extracted from the input frame (e.g., from the short-term feature extractor 226 of FIG. 2) and the input frame. The short-term music likelihood estimator 412 is configured to generate a second estimated coding gain value (e.g., "snr_tcx") corresponding to an estimated coding gain or efficiency of encoding the input frame using a TCX encoder (e.g., the second encoder 134 of FIG. 1).

The long-term decision biasing unit 414 is configured to receive the first estimated coding gain value (e.g., "snr_acelp"), the second estimated coding gain value (e.g., "snr_tcx"), the speech/music decision ("sp_aud_decision") generated by the first classifier 122 as depicted in FIG. 3, and the long-term state data. The long-term decision biasing unit 414 is configured to generate an output based on one or more of the values input to the long-term decision biasing unit 414.

The adjustment parameter generator 416 is configured to receive the first probability data (e.g., "lps") output from the speech model 370 of FIG. 3, the second probability data (e.g., "lpm") output from the music model 372 of FIG. 3, the long-term state data, and the output of the long-term decision biasing unit 414. The adjustment parameter generator 416 is configured to set a value of an adjustment parameter (denoted "dsnr") that is used by the classification decision generator 418 to bias a speech/music decision toward a speech encoder or toward a music encoder. Although the adjustment parameter is labelled "dsnr" in FIG. 4 and in the Examples described below, the adjustment parameter may or may not correspond to a signal-to-noise ratio. For example, in some implementations the adjustment value may represent an offset to a signal-to-noise ratio (e.g., a "delta snr"), while in other implementations the adjustment parameter may correspond to an offset to a coding gain value or a coding gain ratio (e.g., "delta coding gain"), an offset to a coding gain estimate or to one or more other physical values or model parameters, or may be a numerical value that does not have a direct correspondence to a physical value or model parameter. Thus, it should be understood that the label "dsnr" is used for convenience only and does not impose any limitation on the content or use of the adjustment parameter.

The classification decision generator 418 is configured to receive the first estimated coding gain value (e.g., "snr_acelp"), the second estimated coding gain value (e.g., "snr_tcx"), the adjustment parameter (e.g., "dsnr"), the set of short-term features from the short-term feature extractor 226 of FIG. 2, the long-term state data, and the speech/music decision ("sp_aud_decision") generated by the first classifier 122 as depicted in FIG. 3. Based on the received input values, the classification decision generator 418 is configured to output the updated (or modified) classification decision, which may correspond to the second decision data 148 of FIG. 1.

A value of the adjustment parameter ("dsnr") biases the speech/music decision of the classification decision generator 418. For example, a positive value of the adjustment parameter may cause the classification decision generator 418 to be more likely to select a speech encoder for the input frame, and a negative value of the adjustment parameter may cause the classification decision generator 418 to be more likely to select a non-speech encoder for the input frame.

As described with respect to FIG. 4, several parameters are available and may be used to influence or bias the speech/music decision toward speech or non-speech. For example, the short-term probability of speech ("lps"), short-term probability of music ("lpm"), or a combination thereof, calculated by the speech model and the music model as intermediate parameters in obtaining the decision of the first classifier 122 ("sp_aud_decision") may be used to bias the speech/music decision of the second classifier 124.

As another example, the long-term decision of the first classifier 122 ("sp_aud_decision") may be used to bias the speech/music decision of the second classifier 124. As another example, a closeness (e.g., numerical similarity) of short-term coding gain estimates (e.g., "snr_acelp" and "snr_tcx") may be used to bias the speech/music decision of the second classifier 124.

As another example, a number of past consecutive frames which were chosen as ACELP/speech (e.g., in the long-term state data) may be used to bias the speech/music decision of the second classifier 124. Alternatively, a measure of the number of ACELP/speech frames chosen among a subset of the past frames (an example of this could be the percentage of ACELP/speech frames in the past 50 frames) may be used to bias the speech/music decision of the second classifier 124.

As another example, a previous frame decision between ACELP/speech and TCX/music (e.g., in the long-term state data) may be used to bias the speech/music decision of the second classifier 124. As another example, a non-stationarity measure of speech energy ("non_staX") may be estimated as a sum of the ratios of a current frame's energy and the past frame's energy among different bands in frequency. The non-stationarity measure may be included in the set of features provided by the short-term feature extractor 226 of FIG. 2. The non-stationarity measure may be used to bias the speech/music decision of the second classifier 124.

As another example, mean (e.g., average or arithmetic mean) voicing among all (or a subset of) the subframes of an input frame may be used to bias the speech/music decision of the second classifier 124. Mean voicing may include a measure of the normalized correlation of the speech in the subframes with a shifted version of the speech. A shift amount of the shifted version may correspond to a calculated pitch lag of the subframe. A high voicing indicates that the signal is highly repetitive with the repetition interval substantially matching the pitch lag. The mean voicing may be included in the set of features provided by the short-term feature extractor 226 of FIG. 2.

As another example, an offset parameter may be used to bias the speech/music decision of the second classifier 124. For example, if a TCX encoder is used to code music segments, the offset parameter may be incorporated when biasing the speech/music decision. The offset parameter may correspond to an inverse measure of TCX coding gain. The offset parameter may be inversely related to the second estimated coding gain value ("snr_tcx"). In a particular implementation, a determination may be made whether a value of the offset parameter is less than a threshold (e.g., offset<74.0) to impose a minimum criteria corresponding to the second estimated coding gain value ("snr_tcx"). Verifying that the offset parameter is not less than the threshold, in addition to verifying that the first estimated coding gain value ("snr_acelp") exceeds another threshold (e.g., snr_acelp>snr_tcx-4), may indicate whether either or both of the encoders are insufficient for encoding the input frame. If both of the encoders are insufficient for encoding the input frame, a third encoder may be used to encode the input frame. Although several parameters are listed above that may be used to bias an encoder selection, it should be understood that some implementations may exclude one or more of the listed parameters, include one or more other parameters, or any combination thereof.

By modifying (e.g., adjusting a value of) coding gain estimates or measures based on additional data (e.g., data from the first classifier 122 of FIG. 1), the second classifier 124 may reduce a number of false positives and a number of missed detections for selecting frames to be encoded as compared to an implementation that uses a decision from a first classifier (e.g., a model-based classifier or an open-loop classifier) to select either the first encoder 132 or the second encoder 134 for each frame. By using the selected encoder to encode audio frames, artifacts and poor signal quality that result from misclassification of the audio frames and from using the wrong encoder to encode the audio frames may be reduced or eliminated.

Several examples of computer code illustrating possible implementations of aspects described with respect to FIGS. 1-4 are presented below. In the examples, the term "st→" indicates that the variable following the term is a state parameter (e.g., a state of the encoder 104 of FIG. 1, a state of the selector 120 of FIG. 1, or a combination thereof). For example "st→lps" indicates that the short-term probability that the input frame is a speech frame ("lps") is a state parameter. The following examples correspond to an implementation based on the system 100 of FIG. 1, the examples of FIGS. 2-4, or both, and where the first classifier 122 is a model-based classifier, the second classifier 124 is an open-loop classifier, the first encoder 132 includes an ACELP encoder, and the second encoder 134 includes a TCX encoder.

The computer code includes comments which are not part of the executable code. In the computer code, a beginning of a comment is indicated by a forward slash and asterisk (e.g., "/*") and an end of the comment is indicated by an asterisk and a forward slash (e.g., "*/"). To illustrate, a comment "COMMENT" may appear in the pseudo-code as /* COMMENT */.

In the provided examples, the "==" operator indicates an equality comparison, such that "A==B" has a value of TRUE when the value of A is equal to the value of B and has a value of FALSE otherwise. The "&&" operator indicates a logical AND operation. The "H" operator indicates a logical OR operation. The ">" (greater than) operator represents "greater than", the ">=" operator represents "greater than or equal to", and the "<" operator indicates "less than". The term "f" following a number indicates a floating point (e.g., decimal) number format. As noted previously, the "st→A" term indicates that A is a state parameter (i.e., the "→" characters do not represent a logical or arithmetic operation).

In the provided examples, "*" may represent a multiplication operation, "+" or "sum" may represent an addition operation, "−" may indicate a subtraction operation, and "/" may represent a division operation. The "=" operator represents an assignment (e.g., "a=1" assigns the value of 1 to the variable "a"). Other implementations may include one or more conditions in addition to or in place of the set of conditions of Example 1.

The condition "st→lps>st→lpm" indicates that the short-term probability of the current frame being speech-like is higher than the short-term probability of the current frame being music-like, as calculated by the model based classifier. These are intermediate parameters whose values may be provided or tapped out to the second classifier 124 before processing in the state machine 374 takes place in the first classifier 122 (e.g., the model based classifier).

For example, lps may correspond to the log probability of speech given the observed features, and lpm may correspond to the log probability of music give the observed features. For example, $$lps=\log(p(speech|features)*p(features))=\log(p(features|speech)+\log(speech), \text{ and} \quad [Equation 1]:$$

$$lpm=\log(p(music|features)*p(features))=\log(p(features|music))+\log(music), \quad [Equation 2]:$$

where p(x) indicates a probability of x and p(x|y) indicates the probability of x, given y. In some implementations, when performing relative comparisons between lps and lpm, p(features) can be ignored because it is a common term. The term p(features|speech) is the probability of the observed set of features assuming the features belong to speech. The term p(features|speech) can be calculated based on a model for speech. The term p(speech) is the apriori probability of speech. Generally, p(speech)>p(music) for mobile communication applications because the likelihood that someone is speaking into a telephone may be higher than the likelihood that music is being played into the telephone. However, in alternative use cases the p(speech) and p(music) could be arbitrarily related.

The parameters lps and lpm may indicate the likelihood of an observed set of features being speech and music, respectively, with information about speech models, music models, or a combination thereof, along with apriori probabilities of speech and music.

The condition "st→sr_core==12800" may indicate an encoder or an encoder operating mode (e.g., an ACELP core sample rate of 12.8 kHz). For example, in some implementations, a 12.8 kHz encoder operating mode may exhibit increased speech/music misprediction as compared to higher sampling rate encoder operating modes.

The condition "sp_aud_decision0==0" may indicate that the speech/music decision of the first classifier 122 indicates that the input frame is a speech frame. The speech/music decision of the first classifier 122 is generated after the model based parameters lps and lpm are calculated and after the state machine 374 (which considers long-term information so that the sp_aud_decision avoids frequent switching) processing is complete.

The term "st→acelpFramesCount" indicates a count of number of past consecutive frames which were decided to be ACELP (or speech). This count may be used to bias the decision towards speech when the number of past consecutive ACELP frames is relatively high. Using this count to bias the decision may provide an increased biasing effect in borderline cases, such as when lps has a value that is similar to the value of lpm, and when snr_acelp has a value that is similar to the value of snr_tcx. This also avoids frequent switching between ACELP/TCX.

A set of conditions may be evaluated to determine whether to bias a speech/music decision by setting a value of the adjustment parameter "dsnr" as indicated in Example 1.

```
if( (st->sr_core == 12800) && ((st->lps > st->lpm) ||
(st->acelpFramesCount >= 6
&& (st->lps > st->lpm - 1.5f))) && (sp_aud_decision0 == 0) &&
(snr_acelp >=
snr_tcx - 4) && st->acelpFramesCount >= 1)
{
  dsnr = 4.0f; /*To bias the decision towards ACELP*/
}
```

Example 1

It should be noted that st→acelpFramesCount>=1 indicates that the last frame (i.e., the frame that precedes the frame that is currently being evaluated) was determined to be an ACELP frame (e.g., the second decision data 148 indicates a selection of the first encoder 132). If the last frame (the previous frame) was determined to be an ACELP frame, the set of conditions of Example 1 also includes a check for st→lps>st→lpm. However, if the last 6 consecutive frames were determined to be ACELP frames, the set of conditions of Example 1 allows adjusting the adjustment parameter "dsnr" for a current frame to bias a selection toward the current frame being an ACELP frame even if st→lps is less than st→lpm, as long as the value of st→lps is within 1.5 of the value of st→lpm. It should also be noted that st→acelpFramesCount>=6 indicates that at least the last 6 frames were determined to be ACELP frames frame (e.g., the second decision data 148 indicates a selection of the first encoder 132) and it implicitly indicates that the last frame (i.e., the frame that precedes the frame that is currently being evaluated) was determined to be an ACELP frame. To illustrate, in some implementations a value of st→lps may typically be between −27 and 27, and a value of st→lpm may typically be between −16 and 23.

It should be noted that even after the modification of the adjustment parameter (e.g., dsnr=4.0f) as applied in Example 1, in some implementations the value of the adjustment parameter may be further adjusted (e.g., increased or decreased) before being applied during the speech/music decision of the classification decision generator 418. Therefore, the modification of the adjustment parameter "dsnr" in Example 1 increases the probability of, but does not necessarily guarantee, selecting speech/ACELP when the set of conditions of Example 1 is satisfied.

Other implementations may include one or more conditions in addition to or in place of the set of conditions of Example 1. For example, the parameter "non_staX" may indicate a measure of absolute variance in energies in various frequency bands between the current and the past frame. In log domain, non_staX may be the sum of absolute log energy differences between the current and the past frames among different bands. An example of calculation of a value of the parameter non_staX is provided in Example 2.

```
for( band_i = band_start; i < band-stop; i++ )
/*loop from band_start to band-stop*/
{
    log_enr = log(enr[band_i]);
    *non_staX = *non_staX + abs(log_enr -
    st->past_log_enr[band_i]);
    st->past_log_enr[band_i] = log_enr;
}
```

Example 2

Music signals, especially instrumental signals (e.g., violin) have a very high degree of stationarity in all frequency bands but sometimes could be mistaken for voiced speech due to their high harmonicity. A condition of relatively high non-stationarity may be used to reduce a likelihood of encoding stationary instrumental signals as speech (e.g., with an ACELP encoder).

As another example, a condition based on mean voicing "mean(voicing_fr, 4)>=0.3" may be satisfied when an arithmetic mean of values of the parameter voicing_fr within four subframes of the current frame is greater than or equal 0.3. Although four subframes are considered, which may correspond to all subframes of a frame, in other implementations fewer than four subframes may be considered. The parameter voicing_fr may be determined as:

$$\text{voicing_fr}[i] = \frac{\sum_{k=0}^{l_subfr} \text{speech_subfr}_i[k-\tau_i]\cdot\text{speech_subfr}_i[k]}{\sum_{k=0}^{l_subfr} (\text{speech_subfr}_i[k])^2} \quad \text{[Equation 3]}$$

In Equation 3, $\tau_i$ is the pitch period estimated in subframe i. Voicing_fr[i] is the voicing parameter for subframe i. Voicing_fr[i] having a value of 1 indicates that a correlation between the speech in current subframe and the set of samples $\tau_i$ is very high and a value 0 means the correlation is very low. Voicing_fr may be a measure of repetitiveness of speech. A voiced frame is highly repetitive and the condition "mean(voicing_fr, 4)>0.3" may be satisfied for speech-like signals.

As another example, a condition based on the offset parameter "offset<74.0f" may be used when determining whether to bias the speech/music decision toward speech. The offset parameter is inversely related to snr_tcx, meaning that an increase in the offset value would lead to a decrease in snr_tcx and vice-versa, and constraining the offset parameter to have a low value indirectly constrains snr_tcx to have a level that exceeds a lower bound for effective TCX encoding. It should be noted that the offset parameter is calculated within the second classifier based on the long-term state, short-term features, etc. In one implementation, the relation between snr_tcx and offset may be:

$$snr_{tcx} = \alpha\frac{\sum_{i=0}^{63}[s_h(n)]^2}{10^{\left(\frac{offset}{10}\right)}} \quad \text{[Equation 4]}$$

(where $S_h$ is the weighted speech and where weighting is done on the LPCs of the input speech) or $$snr_{tcx} = \alpha\frac{\sum_{i=0}^{3}\log(\text{energy_subframe}[i])}{10^{\left(\frac{offset}{10}\right)}}. \quad \text{[Equation 5]}$$

As another example, a speech/music decision may be biased towards music when "sp_aud_decision0==1" (e.g., the first decision data 146 indicates a music frame) to reduce the occurrence of ACELP frames in a music signal, as illustrated in Example 3.

```
if((st->sr_core == 12800) && sp_aud_decision0 == 1)
{
    /* Increase the probability of picking TCX, biasing the decision
    towards TCX*/
    dsnr = -2.0f;
}
```

Example 3

An expanded set of proposed conditions as compared to Example 1 to bias the decision of the second classifier 124 towards either ACELP or TCX is provided in Example 4.

```
if((st->sr_core == 12800) && ((st->lps > st->lpm) &&
mean(voicing_fr, 4) >= 0.3f ||
(st->acelpFramesCount >= 6 && (st->lps > st->lpm - 1.5f))) &&
(sp_aud_decision0
== 0) && (non_staX > 5.0f) && (snr_acelp >= snr_tcx - 4) && st-
>acelpFramesCount >= 1 && (offset < 74.0f))
{
    /*Bias the decision towards ACELP/SPEECH */
    dsnr = 4.0f;
}
else if((st->sr_core == 12800) && sp_aud_decision0 == 1)
{
    /* Increase the probability of picking TCX, biasing the decision
    towards TCX*/
    dsnr = -2.0f;
}
```

Example 4

Another set of proposed conditions to bias the decision of the second classifier 124 towards either ACELP or TCX is provided in Example 5. In Example 5, mean(voicing_fr, 4) being higher than 0.3 stands as an independent condition.

```
if( (st->sr_core == 12800) && mean(voicing_fr, 4) >= 0.3f &&
((st->lps > st->lpm) ||
(st->acelpFramesCount >= 6 && (st->lps > st->lpm - 1.5f))) &&
(sp_aud_decision0
== 0) && (non_staX > 5.0f) && (snr_acelp >= snr_tcx - 4) && st-
>acelpFramesCount >= 1 && (offset < 74.0f))
{
    /*Bias the decision towards ACELP/SPEECH */
    dsnr = 4.0f;
}
else if((st->sr_core == 12800) && sp_aud_decision0 == 1)
{
    /* Increase the probability of picking TCX, biasing the decision
    towards TCX*/
    dsnr = -2.0f;
}
```

Example 5

Although Examples 1 and 3-5 provide examples of sets of conditions corresponding to setting values of the adjustment parameter "dsnr", other implementations may exclude one or more conditions, include one or more other conditions, or any combination thereof. For example, although Examples 1 and 3-5 include the condition "st→sr_core==12800", indicating a encoder operating mode (e.g., a 12.8 kHz sample rate) that may exhibit increased speech/music misprediction, in other implementations one or more other encoder modes, or no encoder mode, may be included in a set of conditions to set the adjustment parameter. Although numerical values (e.g., 74.0f) are provided in some of the Examples, such values are provided as examples only, and other values may be determined to provide reduced misprediction in other implementations. Additionally, the parameter indications (e.g., "lps", "lpm", etc.) used herein are for illustration only. In other implementations, the parameters may be referred to by different names. For example, the probability of speech parameter may be referred to by "prob_s" or "lp_prob_s". Further, time-averaged (low pass) parameters (referred to by "lp") have been described, FIGS. 1-4 and the Examples 1 and 3-5 could use other parameters (e.g., "prob_s", "prob_m", etc.) in place of a time-averaged or low pass parameter.

Figure 5:
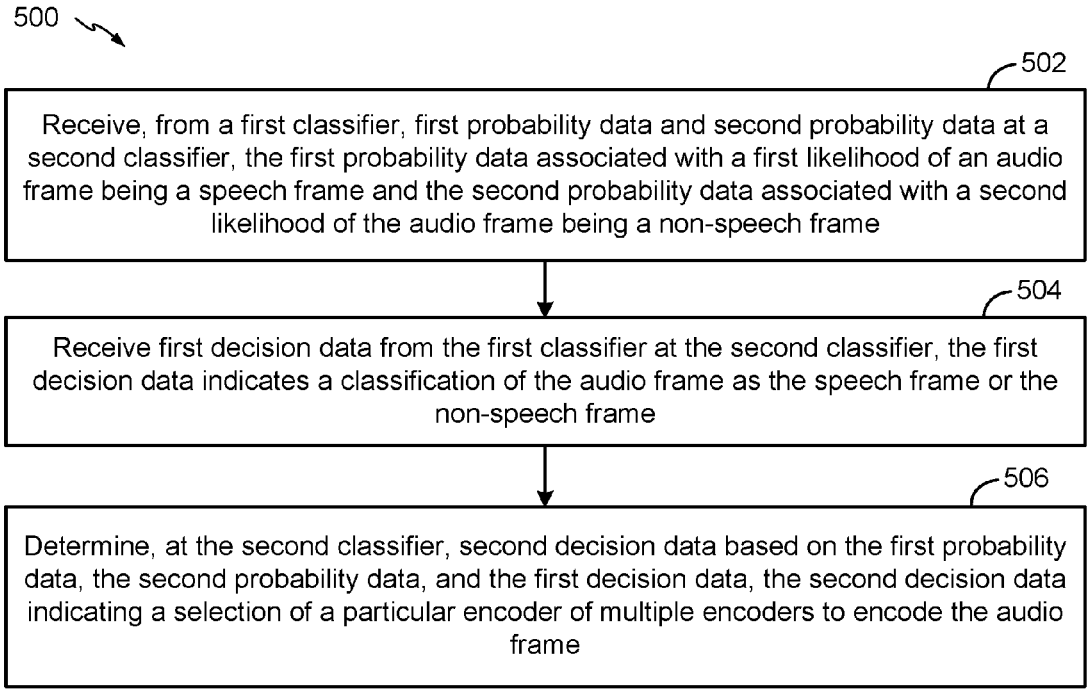
FIG. 5 is a flow chart illustrating a method of selecting an encoder.

FIG. 5 is a flow chart illustrating a method 500 of determining a selection of an encoder. The method 500 may be performed in or by an encoder that selects between speech encoding and non-speech encoding. For example, the method 500 may be performed at the encoder 104 of FIG. 1.

The method 500 includes receiving, from a first classifier, first probability data and second probability data at a second classifier, at 502. The first probability data is associated with a first likelihood of an audio frame being a speech frame and the second probability data is associated with a second likelihood of the audio frame being a non-speech frame. To illustrate, the first probability data 142 and the second probability data 144 are received at the second classifier 124 from the first classifier 122 of FIG. 1. For example, the first classifier may be associated with a model based classifier, and the second classifier may be associated with an open-loop model or an open-loop classifier.

First decision data may be received from the first classifier at the second classifier, the first decision data indicating a classification of the audio frame as the speech frame or the non-speech frame, at 504. The first decision data may be received at the second classifier from a state machine of the first classifier. For example, the first decision data may correspond to the first decision data 146 of FIG. 1.

The method 500 also includes determining, at the second classifier, second decision data based on the first probability data, the second probability data, and the first decision data, at 506. The second decision data is configured to indicate a selection of a particular encoder of multiple encoders to encode the audio frame. For example, the multiple encoders may include a first encoder and a second encoder, such as the first encoder 132 and the second encoder 134 of FIG. 1, respectively. The first encoder may include a speech encoder, and the second encoder may include a non-speech encoder. To illustrate, the non-speech encoder may include a music encoder, such as a TCX encoder.

The method 500 may include providing the second decision data from an output of the second classifier to a switch configured to select a particular encoder of the multiple encoders. The audio frame is encoded using the selected encoder. For example, the second classifier 124 of FIG. 1 may output the second decision data 148 that is provided to the switch 130 to select one of the first encoder 132 or the second encoder 134.

The method 500 may include determining a first estimated coding gain value associated with a first encoder of the multiple encoders being used to encode the audio frame and determining a second estimated coding gain value associated with a second encoder of the multiple encoders being used to encode the audio frame. For example, the first estimated coding gain value may correspond to a value (e.g., snr_acelp) output by the short-term speech likelihood estimator 410 of FIG. 4 and the second estimated coding gain value may correspond to a value (e.g., snr_tcx) output by the short-term music likelihood estimator 412. The method 500 may include adjusting the first estimated coding gain value based on a value of an adjustment parameter. For example, a value of the adjustment parameter "dsnr" in FIG. 4 may be output by the adjustment parameter generator 416 of FIG. 4 and may be used by the classification decision generator 418 to adjust a value of snr_acelp. The selection of the one or more encoders may be based on the adjusted first estimated coding gain value and the second estimated coding gain value.

The method 500 may include selecting a value of the adjustment parameter (e.g., "dsnr"). The value may be selected based on at least one of the first probability data (e.g., lps), the second probability data (e.g., lpm), long-term state data, or the first decision (e.g., sp_aud_decision). For example, a value of the adjustment parameter may be selected by the adjustment parameter generator 416 of FIG. 4. The second decision data may be determined based on the value of the adjustment parameter, such as the output of the classification decision generator 418 that is responsive to the value of the adjustment parameter that is received from the adjustment parameter generator 416. The value of the adjustment parameter may be selected to bias the selection toward a first encoder associated with speech or a second encoder associated with non-speech.

The method 500 may include determining whether a set of conditions associated with an audio frame is satisfied and, in response to the set of conditions being satisfied, selecting a value of an adjustment parameter to bias the selection toward a first encoder associated with speech. The set of conditions may be determined to be satisfied at least in part in response to determining that the audio frame is associated with a core sample rate of 12.8 kHz, such as the condition "st→sr_core==12800" in Example 1. The set of conditions may be determined to be satisfied at least in part in response to determining that the first decision data indicates that the audio frame is classified as the speech frame, such as the condition "sp_aud_decision0==0" in Example 1. The set of conditions may be determined to be satisfied at least in part in response to determining a first estimated coding gain value associated with the first encoder (e.g., snr_acelp) being used to encode the audio frame is greater than or equal to a first value. The first value may be associated with a difference between a second estimated coding gain value (e.g., snr_tcx) and a second value (e.g., 4), such as the condition "snr_acelp>=snr_tcx−4" in Example 1. The set of conditions may be determined to be satisfied at least in part in response to determining a most recently classified frame is classified as including speech content (e.g., "st→acelpFramesCount>=1" in Example 1) and determining that a first probability value indicated by the first probability data is greater than a second probability value indicated by the second probability (e.g., "st→lps>st→lpm" of Example 1).

The set of conditions may be determined to be satisfied at least in part in response to determining that each frame corresponding to a number of most recently classified frames is classified as including speech content (e.g., "st→acelpFramesCount>=6" in Example 1) and determining that a first probability value indicated by the first probability data (e.g., "st→lps") is greater than or equal to a third value (e.g., "st→lpm−1.5" in Example 1). The third value may be associated with a difference between a second probability value indicated by the second probability data (e.g., "st→lpm") and a fourth value (e.g., 1.5).

The set of conditions may be determined to be satisfied at least in part in response to determining a mean voicing value of multiple sub-frames of the audio frame is greater than or equal to a first threshold (e.g., "mean(voicing_fr, 4)>=0.3" in Example 4), determining a non-stationarity value associated with the audio frame is greater than a second threshold (e.g., "non-staX>5.0" in Example 4), and determining an offset value associated with the audio frame is less than a third threshold (e.g., "offset<74" in Example 4).

In a particular aspect, the method 500 includes determining whether a second set of conditions associated with an audio frame is satisfied and, in response to the second set of conditions being satisfied, selecting a value of an adjustment parameter to bias the selection toward a second encoder associated with non-speech, such as described with respect to Example 3. The second set of conditions may be determined to be satisfied at least in part in response to determining that the audio frame is associated with a core sample rate of 12.8 kHz (e.g., "st→st core==12800" in Example 3). Alternatively or in addition, the second set of conditions may be determined to be satisfied at least in part in response to determining that the first decision data indicates the audio frame is classified as the non-speech frame (e.g., "sp_aud_decision0==1" in Example 3).

The method 500 may enable more accurate classification of a particular audio frame and improved selection of an encoder to be used to encode the particular audio frame. By using the probability data and the first decision data from the first classifier to determine the selection, audio frames may be accurately classified as speech frames or music frames and a number of misclassified speech frames may be reduced as compared to conventional classification techniques. Based on the classified audio frames, an encoder (e.g., a speech encoder or a non-speech encoder) may be selected to encode the audio frame. By using the selected encoder to encode the speech frames, artifacts and poor signal quality that result from misclassification of audio frames and from using the wrong encoder to encode the audio frames may be reduced.

Figure 6:
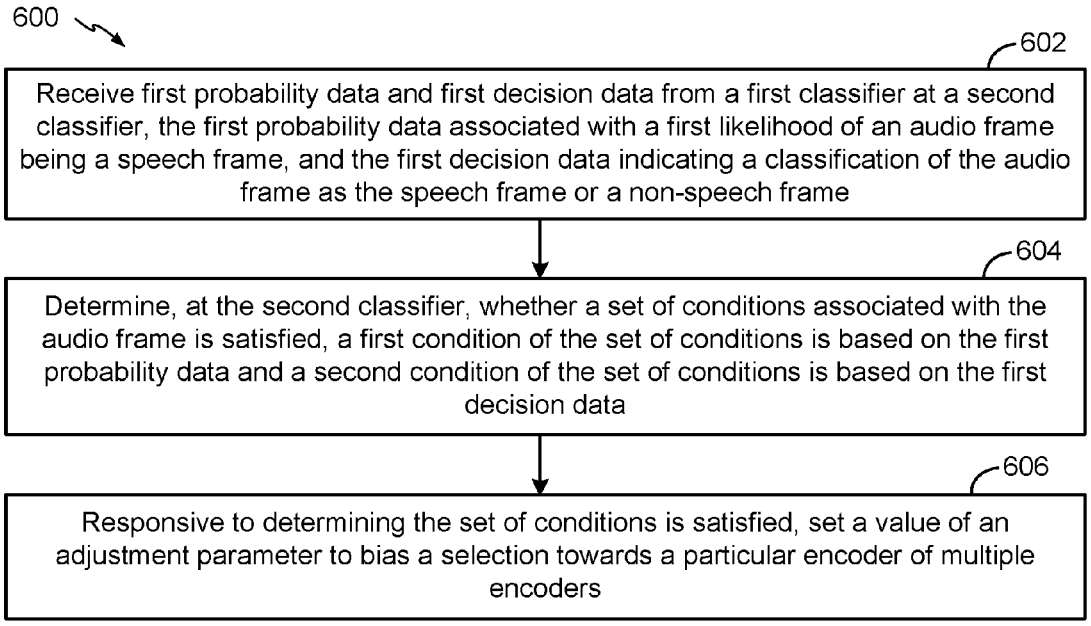
FIG. 6 is a flow chart illustrating a method of selecting a value of an adjustment parameter to bias a selection towards a particular encoder.

FIG. 6 is a flow chart illustrating a method 600 of selecting a value of an adjustment parameter to bias a selection towards a particular encoder. The method 600 may be performed in or by an encoder that selects between speech encoding and non-speech encoding. For example, the method 600 may be performed at the encoder 104 of FIG. 1.

First probability data and first decision data from a first classifier are received at a second classifier, at 602. The first probability data is associated with a first likelihood of an audio frame being a speech frame. For example, the first probability data may correspond to the first probability data 142, the second probability data 144, or a combination thereof, received at the second classifier 124 from the first classifier 122 of FIG. 1. The first decision data indicates a classification of the audio frame as the speech frame or a non-speech frame, such as the first decision data 146 of FIG. 1.

The method 600 also includes determining, at the second classifier, whether a set of conditions associated with the audio frame is satisfied, at 604. A first condition of the set of conditions is based on the first probability data and a second condition of the set of conditions is based on the first decision data. For example, the first condition may correspond to "st→lps>st→lpm" in Example 1, and the second condition may correspond to "sp_aud_decision0==0" in Example 1.

The method 600 further includes, responsive to determining the set of conditions is satisfied, setting a value of an adjustment parameter to bias a first selection towards a first encoder of multiple encoders, at 606. For example, the value of the adjustment parameter may correspond to a value of an output of the adjustment parameter generator 416 of FIG. 4 that is provided to the classification decision generator 418. To illustrate, setting the value of the adjustment parameter to bias the first selection towards the first encoder may correspond to setting (or updating) a value of the adjustment parameter, such as "dnsr=4.0" in Example 1. The first encoder may include or correspond to a speech encoder.

In a particular aspect, the set of conditions is determined to be satisfied at least in part in response to determining that the audio frame is associated with a sample rate of 12.800 kHz (e.g., "st→sr_core==12800" in Example 1). The set of conditions may be determined to be satisfied at least in part in response to determining that the first decision data indicates the classification of the audio frame as the speech frame (e.g., "sp_aud_decision0==0" in Example 1). The set of conditions may be determined to be satisfied at least in part in response to determining a first estimated coding gain value associated with encoding the audio frame at the first encoder (e.g., "snr_acelp") is greater than or equal to a first value, the first value associated with a difference between a second estimated coding gain value (e.g., "snr_tcx") and a second value (e.g., "snr_acelp>=snr_tcx−4" in Example 1).

In a particular aspect, the set of conditions is determined to be satisfied at least in part in response to determining a most recently classified frame is classified as including speech content (e.g., "st→acelpFramesCount>=1" in Example 1). In a particular aspect, the set of conditions is determined to be satisfied at least in part in response to determining that a first probability value indicated by the first probability data is greater than a second probability value indicated by second probability data (e.g., "st→lps>st-lpm"), the second probability data associated with a second likelihood of the audio frame being a non-speech frame.

The set of conditions may be determined to be satisfied at least in part in response to determining that each frame corresponding to a number of most recently classified frames is classified as including speech content (e.g., "st→acelpFramesCount>=6"). The set of conditions may be determined to be satisfied at least in part in response to determining that a first probability value indicated by the first probability data (e.g., "st→lps") is greater than or equal to a third value, the third value associated with a difference between a second probability value indicated by second probability data (e.g., "st→lpm") and a fourth value, such as the condition "st→lps>st-lpm−1.5" in Example 1. The second probability data may be associated with a second likelihood of the audio frame being a non-speech frame.

The set of conditions may be determined to be satisfied at least in part in response to determining a mean voicing value of multiple sub-frames of the audio frame is greater than or equal to a first threshold (e.g., "mean(voicing_fr, 4)>=0.3" in Example 4). The set of conditions may be determined to be satisfied at least in part in response to determining a non-stationarity value associated with the audio frame is greater than a second threshold (e.g., "non_staX>5.0" in Example 4). The set of conditions may be determined to be satisfied at least in part in response to determining an offset value associated with the audio frame is less than a third threshold (e.g., "offset<74.0" in Example 4).

In some implementations, the method 600 may include determining whether a second set of conditions associated with the audio frame is satisfied, such as the set of conditions of Example 3. The method 600 may also include, responsive to determining the second set of conditions is satisfied, updating the value of the adjustment parameter from the first value to a second value to bias a second selection towards a second encoder of the multiple encoders, the second encoder including a non-speech encoder. For example, updating the value of the adjustment parameter to bias a second selection towards the second encoder may be performed by setting a value of the output of the adjustment parameter generator 416 of FIG. 4 (e.g., "dsnr=−2.0" in Example 3). To illustrate, the second set of conditions may be determined to be satisfied in response to determining that the audio frame is associated with a sample rate of 12.8 kHz and determining that the first decision data indicates the classification of the audio frame as the non-speech frame (e.g., "(st→sr_core==12800) && (sp_aud_decision0==1)" in Example 3).

By using the adjustment parameter to determine the selection, audio frames may be classified as speech frames or music frames and a number of misclassified speech frames may be reduced as compared to conventional classification techniques. Based on the classified audio frames, an encoder (e.g., a speech encoder or a non-speech encoder) may be selected to encode the audio frame. By using the selected encoder to encode the speech frames, artifacts and poor signal quality that result from misclassification of audio frames and from using the wrong encoder to encode the audio frames may be reduced.

In particular aspects, one or more of the methods of FIGS. 5-6, the Examples 1-5, or combination thereof, may be implemented by a field-programmable gate array (FPGA) device, an application-specific integrated circuit (ASIC), a processing unit such as a central processing unit (CPU), a digital signal processor (DSP), a controller, another hardware device, firmware device, or any combination thereof. As an example, one or more of the methods of FIGS. 5-6, the Examples 1-5, or a combination thereof, individually or in combination, may be performed by a processor that executes instructions, as described with respect to FIGS. 7 and 8. To illustrate, a portion of the method 500 of FIG. 5 may be combined with a second portion of FIG. 6 or with a third portion of Example 1.

Figure 7:
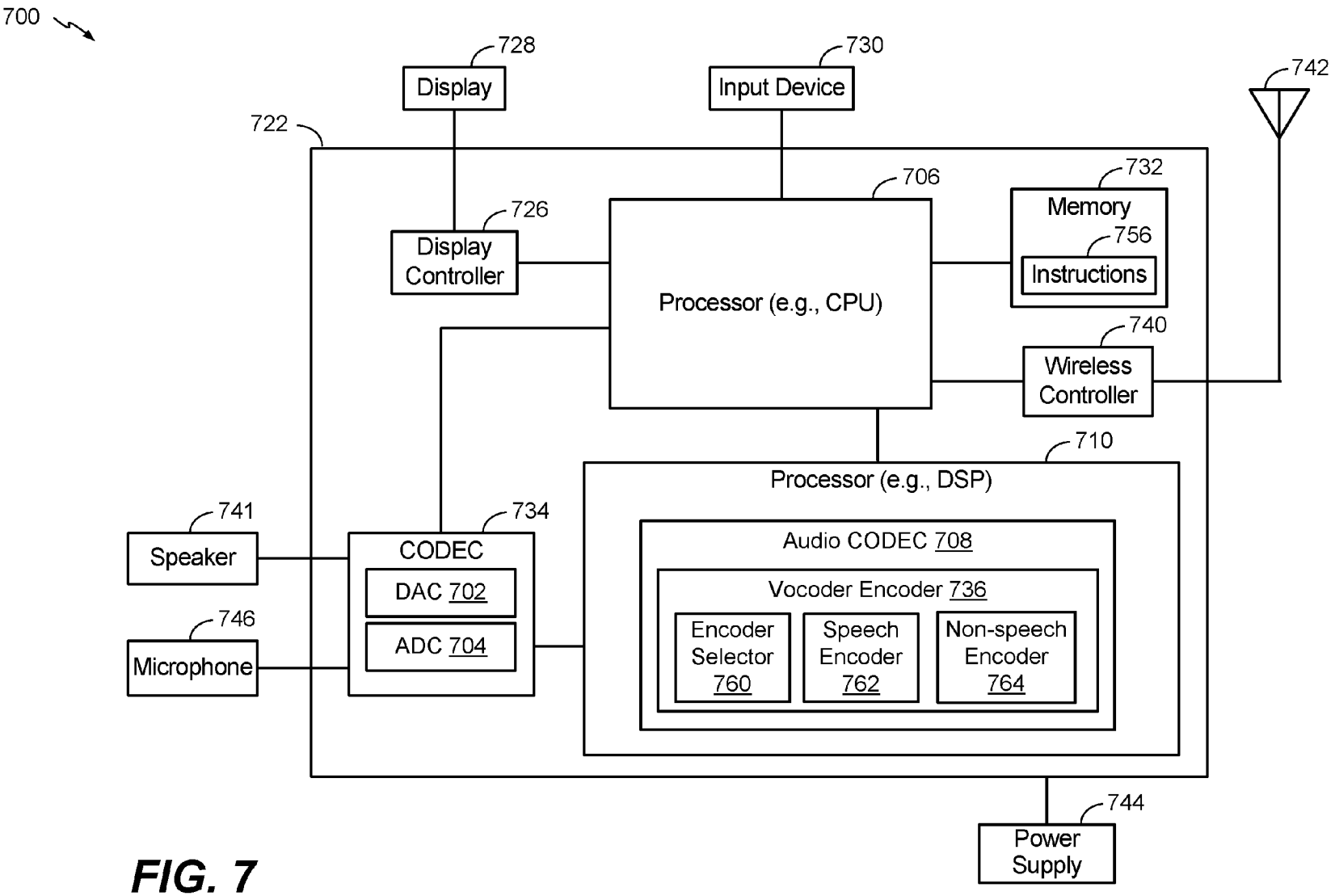
FIG. 7 is a block diagram of a particular illustrative aspect of a device that is operable to select an encoder.

Referring to FIG. 7, a block diagram of a particular illustrative example of a device 700 (e.g., a wireless communication device) is depicted. In various implementations, the device 700 may have more or fewer components than illustrated in FIG. 7. In an illustrative example, the device 700 may correspond to the device 102 of FIG. 1. In an illustrative example, the device 700 may operate according to one or more of the methods of FIGS. 5-6, one or more of the Examples 1-5, or a combination thereof.

In a particular example, the device 700 includes a processor 706 (e.g., a CPU). The device 700 may include one or more additional processors, such as a processor 710 (e.g., a DSP). The processor 710 may include an audio coder-decoder (CODEC) 708. For example, the processor 710 may include one or more components (e.g., circuitry) configured to perform operations of the audio CODEC 708. As another example, the processor 710 may be configured to execute one or more computer-readable instructions to perform the operations of the audio CODEC 708. Although the audio CODEC 708 is illustrated as a component of the processor 710, in other examples one or more components of the audio CODEC 708 may be included in the processor 706, a CODEC 734, another processing component, or a combination thereof.

The audio CODEC 708 may include a vocoder encoder 736. The vocoder encoder 736 may include an encoder selector 760, a speech encoder 762, and a non-speech encoder 764. For example, the speech encoder 762 may correspond to the first encoder 132 of FIG. 1, the non-speech encoder 764 may correspond to the second encoder 134 of FIG. 1, and the encoder selector 760 may correspond to the selector 120 of FIG. 1.

The device 700 may include a memory 732 and a CODEC 734. The memory 732, such as a computer-readable storage device, may include instructions 756. The instructions 756 may include one or more instructions that are executable by the processor 706, the processor 710, or a combination thereof, to perform one or more of the methods of FIGS. 5-6, the Examples 1-5, or a combination thereof. The device 700 may include a wireless controller 740 coupled (e.g., via a transceiver) to an antenna 742.

The device 700 may include a display 728 coupled to a display controller 726. A speaker 741, a microphone 746, or both, may be coupled to the CODEC 734. The CODEC 734 may include a digital-to-analog converter (DAC) 702 and an analog-to-digital converter (ADC) 704. The CODEC 734 may receive analog signals from the microphone 746, convert the analog signals to digital signals using the ADC 704, and provide the digital signals to the audio CODEC 708. The audio CODEC 708 may process the digital signals. In some implementations, the audio CODEC 708 may provide digital signals to the CODEC 734. The CODEC 734 may convert the digital signals to analog signals using the DAC 702 and may provide the analog signals to the speaker 741.

The encoder selector 760 may be used to implement a hardware implementation of the encoder selection, including biasing of the encoder selection via setting (or updating) a value of an adjustment parameter based on one or more sets of conditions, as described herein. Alternatively, or in addition, a software implementation (or combined software/hardware implementation) may be implemented. For example, the instructions 756 may be executable by the processor 710 or other processing unit of the device 700 (e.g., the processor 706, the CODEC 734, or both). To illustrate, the instructions 756 may correspond to operations described as being performed with respect to the selector 120 of FIG. 1.

In a particular implementation, the device 700 may be included in a system-in-package or system-on-chip device 722. In a particular implementation, the memory 732, the processor 706, the processor 710, the display controller 726, the CODEC 734, and the wireless controller 740 are included in a system-in-package or system-on-chip device 722. In a particular implementation, an input device 730 and a power supply 744 are coupled to the system-on-chip device 722. Moreover, in a particular implementation, as illustrated in FIG. 7, the display 728, the input device 730, the speaker 741, the microphone 746, the antenna 742, and the power supply 744 are external to the system-on-chip device 722. In a particular implementation, each of the display 728, the input device 730, the speaker 741, the microphone 746, the antenna 742, and the power supply 744 may be coupled to a component of the system-on-chip device 722, such as an interface or a controller.

The device 700 may include a communication device, an encoder, a decoder, a smart phone, a cellular phone, a mobile communication device, a laptop computer, a computer, a tablet, a personal digital assistant (PDA), a set top box, a video player, an entertainment unit, a display device, a television, a gaming console, a music player, a radio, a digital video player, a digital video disc (DVD) player, a tuner, a camera, a navigation device, a decoder system, an encoder system, a base station, a vehicle, or a combination thereof.

In an illustrative implementation, the processor 710 may be operable to perform all or a portion of the methods or operations described with reference to FIGS. 1-6, Examples 1-5, or a combination thereof. For example, the microphone 746 may capture an audio signal corresponding to a user speech signal. The ADC 704 may convert the captured audio signal from an analog waveform into a digital waveform comprised of digital audio samples. The processor 710 may process the digital audio samples.

The vocoder encoder 736 may determine, on a frame-by-frame basis, whether each received frame of the digital audio samples corresponds to speech or non-speech audio data and may select a corresponding encoder (e.g., the speech encoder 762 or the non-speech encoder 764) to encode the frame. Encoded audio data generated at the vocoder encoder 736 may be provided to the wireless controller 740 for modulation and transmission of the modulated data via the antenna 742.

The device 700 may therefore include a computer-readable storage device (e.g., the memory 732) storing instructions (e.g., the instructions 756) that, when executed by a processor (e.g., the processor 706 or the processor 710), cause the processor to perform operations including determining first probability data (e.g., the first probability data 142 of FIG. 1) associated with a first likelihood of an audio frame being a speech frame and determining second probability data (e.g., the second probability data 144 of FIG. 1) associated with a second likelihood of the audio frame being a non-speech frame. The operations may also include determining first decision data (e.g., the first decision data 146 of FIG. 1) based on the first probability data and the second probability data. The first decision data indicates a classification of the audio frame as the speech frame or the non-speech frame. The operations may also include determining second decision data (e.g., the second decision data 148 of FIG. 1) based on the first probability data, the second probability data, and the first decision data. The second decision data indicates a selection of an encoder (e.g., the speech encoder 762 or the non-speech encoder 764) to encode the audio frame.

Figure 8:
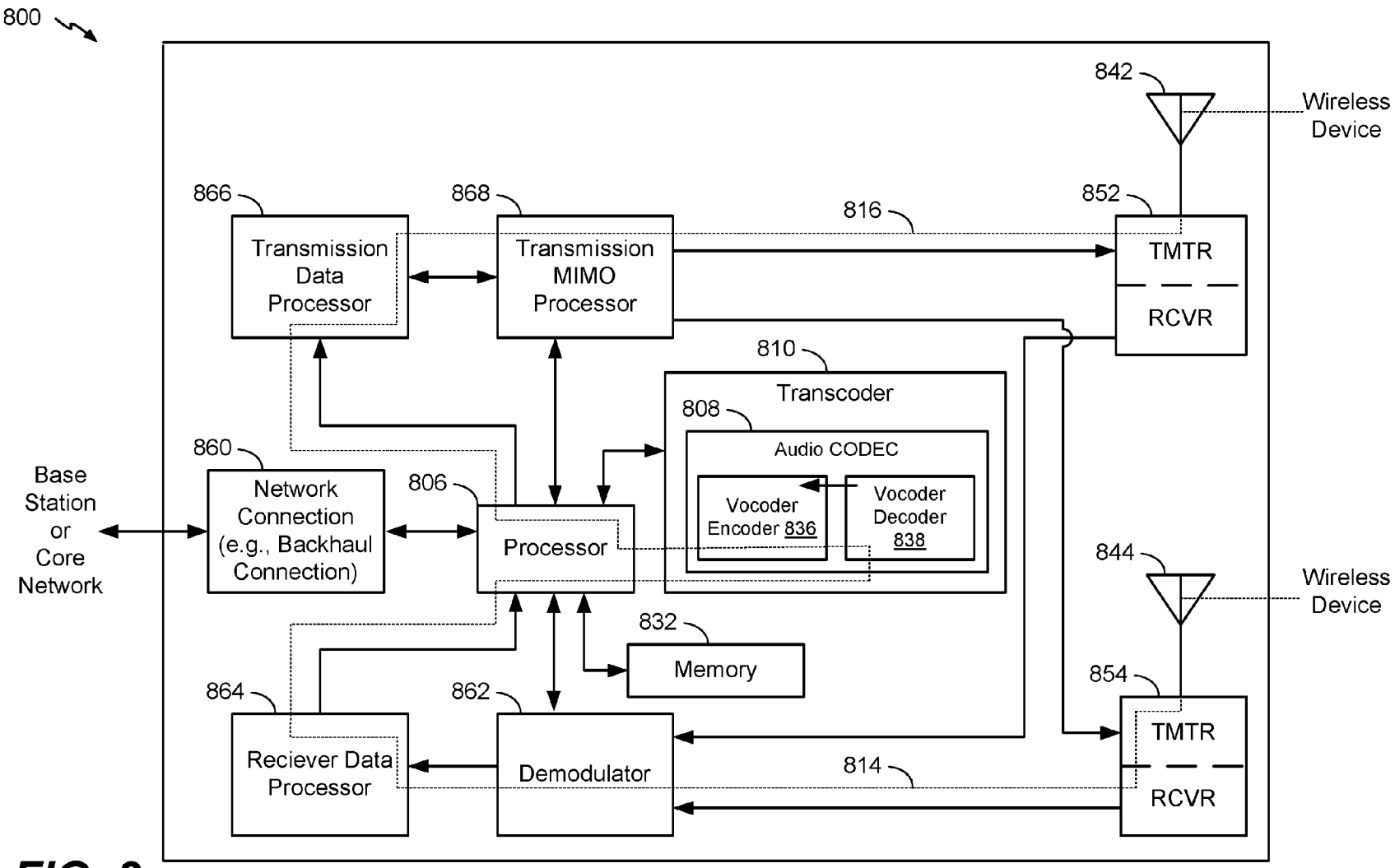
FIG. 8 is a block diagram of a particular illustrative aspect of a base station that is operable to select an encoder.

Referring to FIG. 8, a block diagram of a particular illustrative example of a base station 800 is depicted. In various implementations, the base station 800 may have more components or fewer components than illustrated in FIG. 8. In an illustrative example, the base station 800 may include the device 102 of FIG. 1. In an illustrative example, the base station 800 may operate according to one or more of the methods of FIGS. 5-6, one or more of the Examples 1-5, or a combination thereof The base station 800 may be part of a wireless communication system. The wireless communication system may include multiple base stations and multiple wireless devices. The wireless communication system may be a Long Term Evolution (LTE) system, a Code Division Multiple Access (CDMA) system, a Global System for Mobile Communications (GSM) system, a wireless local area network (WLAN) system, or some other wireless system. A CDMA system may implement Wideband CDMA (WCDMA), CDMA 1×, Evolution-Data Optimized (EVDO), Time Division Synchronous CDMA (TD-SCDMA), or some other version of CDMA.

The wireless devices may also be referred to as user equipment (UE), a mobile station, a terminal, an access terminal, a subscriber unit, a station, etc. The wireless devices may include a cellular phone, a smartphone, a tablet, a wireless modem, a personal digital assistant (PDA), a handheld device, a laptop computer, a smartbook, a netbook, a tablet, a cordless phone, a wireless local loop (WLL) station, a Bluetooth device, etc. The wireless devices may include or correspond to the device 700 of FIG. 7.

Various functions may be performed by one or more components of the base station 800 (and/or in other components not shown), such as sending and receiving messages and data (e.g., audio data). In a particular example, the base station 800 includes a processor 806 (e.g., a CPU). The base station 800 may include a transcoder 810. The transcoder 810 may include an audio CODEC 808. For example, the transcoder 810 may include one or more components (e.g., circuitry) configured to perform operations of the audio CODEC 808. As another example, the transcoder 810 may be configured to execute one or more computer-readable instructions to perform the operations of the audio CODEC 808. Although the audio CODEC 808 is illustrated as a component of the transcoder 810, in other examples one or more components of the audio CODEC 808 may be included in the processor 806, another processing component, or a combination thereof. For example, a vocoder decoder 838 may be included in a receiver data processor 864. As another example, a vocoder encoder 836 may be included in a transmission data processor 866.

The transcoder 810 may function to transcode messages and data between two or more networks. The transcoder 810 may be configured to convert message and audio data from a first format (e.g., a digital format) to a second format. To illustrate, the vocoder decoder 838 may decode encoded signals having a first format and the vocoder encoder 836 may encode the decoded signals into encoded signals having a second format. Additionally or alternatively, the transcoder 810 may be configured to perform data rate adaptation. For example, the transcoder 810 may downconvert a data rate or upconvert the data rate without changing a format the audio data. To illustrate, the transcoder 810 may downconvert 64 kbit/s signals into 16 kbit/s signals.

The audio CODEC 808 may include the vocoder encoder 836 and the vocoder decoder 838. The vocoder encoder 836 may include an encoder selector, a speech encoder, and a non-speech encoder, as described with reference to FIG. 7. The vocoder decoder 838 may include a decoder selector, a speech decoder, and a non-speech decoder.

The base station 800 may include a memory 832. The memory 832, such as a computer-readable storage device, may include instructions. The instructions may include one or more instructions that are executable by the processor 806, the transcoder 810, or a combination thereof, to perform one or more of the methods of FIGS. 5-6, the Examples 1-5, or a combination thereof. The base station 800 may include multiple transmitters and receivers (e.g., transceivers), such as a first transceiver 852 and a second transceiver 854, coupled to an array of antennas. The array of antennas may include a first antenna 842 and a second antenna 844. The array of antennas may be configured to wirelessly communicate with one or more wireless devices, such as the device 700 of FIG. 7. For example, the second antenna 844 may receive a data stream 814 (e.g., a bit stream) from a wireless device. The data stream 814 may include messages, data (e.g., encoded speech data), or a combination thereof.

The base station 800 may include a network connection 860, such as backhaul connection. The network connection 860 may be configured to communicate with a core network or one or more base stations of the wireless communication network. For example, the base station 800 may receive a second data stream (e.g., messages or audio data) from a core network via the network connection 860. The base station 800 may process the second data stream to generate messages or audio data and provide the messages or the audio data to one or more wireless device via one or more antennas of the array of antennas or to another base station via the network connection 860. In a particular implementation, the network connection 860 may be a wide area network (WAN) connection, as an illustrative, non-limiting example.

The base station 800 may include a demodulator 862 that is coupled to the transceivers 852, 854, the receiver data processor 864, and the processor 806, and the receiver data processor 864 may be coupled to the processor 806. The demodulator 862 may be configured to demodulate modulated signals received from the transceivers 852, 854 and to provide demodulated data to the receiver data processor 864. The receiver data processor 864 may be configured to extract a message or audio data from the demodulated data and send the message or the audio data to the processor 806.

The base station 800 may include a transmission data processor 866 and a transmission multiple input-multiple output (MIMO) processor 868. The transmission data processor 866 may be coupled to the processor 806 and the transmission MIMO processor 868. The transmission MIMO processor 868 may be coupled to the transceivers 852, 854 and the processor 806. The transmission data processor 866 may be configured to receive the messages or the audio data from the processor 806 and to code the messages or the audio data based on a coding scheme, such as CDMA or orthogonal frequency-division multiplexing (OFDM), as an illustrative, non-limiting examples. The transmission data processor 866 may provide the coded data to the transmission MIMO processor 868.

The coded data may be multiplexed with other data, such as pilot data, using CDMA or OFDM techniques to generate multiplexed data. The multiplexed data may then be modulated (i.e., symbol mapped) by the transmission data processor 866 based on a particular modulation scheme (e.g., Binary phase-shift keying ("BPSK"), Quadrature phase-shift keying ("QSPK"), M-ary phase-shift keying ("M-PSK"), M-ary Quadrature amplitude modulation ("M-QAM"), etc.) to generate modulation symbols. In a particular implementation, the coded data and other data may be modulated using different modulation schemes. The data rate, coding, and modulation for each data stream may be determined by instructions executed by processor 806.

The transmission MIMO processor 868 may be configured to receive the modulation symbols from the transmission data processor 866 and may further process the modulation symbols and may perform beamforming on the data. For example, the transmission MIMO processor 868 may apply beamforming weights to the modulation symbols. The beamforming weights may correspond to one or more antennas of the array of antennas from which the modulation symbols are transmitted.

During operation, the second antenna 844 of the base station 800 may receive a data stream 814. The second transceiver 854 may receive the data stream 814 from the second antenna 844 and may provide the data stream 814 to the demodulator 862. The demodulator 862 may demodulate modulated signals of the data stream 814 and provide demodulated data to the receiver data processor 864. The receiver data processor 864 may extract audio data from the demodulated data and provide the extracted audio data to the processor 806.

The processor 806 may provide the audio data to the transcoder 810 for transcoding. The vocoder decoder 838 of the transcoder 810 may decode the audio data from a first format into decoded audio data and the vocoder encoder 836 may encode the decoded audio data into a second format. In some implementations, the vocoder encoder 836 may encode the audio data using a higher data rate (e.g., upconvert) or a lower data rate (e.g., downconvert) than received from the wireless device. In other implementations the audio data may not be transcoded. Although transcoding (e.g., decoding and encoding) is illustrated as being performed by a transcoder 810, the transcoding operations (e.g., decoding and encoding) may be performed by multiple components of the base station 800. For example, decoding may be performed by the receiver data processor 864 and encoding may be performed by the transmission data processor 866.

The vocoder decoder 838 and the vocoder encoder 836 may determine, on a frame-by-frame basis, whether each received frame of the data stream 814 corresponds to speech or non-speech audio data and may select a corresponding decoder (e.g., a speech decoder or a non-speech decoder) and a corresponding encoder to transcode (e.g., decode and encode) the frame. Encoded audio data generated at the vocoder encoder 836, such as transcoded data, may be provided to the transmission data processor 866 or the network connection 860 via the processor 806.

The transcoded audio data from the transcoder 810 may be provided to the transmission data processor 866 for coding according to a modulation scheme, such as OFDM, to generate the modulation symbols. The transmission data processor 866 may provide the modulation symbols to the transmission MIMO processor 868 for further processing and beamforming. The transmission MIMO processor 868 may apply beamforming weights and may provide the modulation symbols to one or more antennas of the array of antennas, such as the first antenna 842 via the first transceiver 852. Thus, the base station 800 may provide a transcoded data stream 816, that corresponds to the data stream 814 received from the wireless device, to another wireless device. The transcoded data stream 816 may have a different encoding format, data rate, or both, than the data stream 814. In other implementations, the transcoded data stream 816 may be provided to the network connection 860 for transmission to another base station or a core network.

The base station 800 may therefore include a computer-readable storage device (e.g., the memory 832) storing instructions that, when executed by a processor (e.g., the processor 806 or the transcoder 810), cause the processor to perform operations including determining first probability data associated with a first likelihood of an audio frame being a speech frame and determining second probability data associated with a second likelihood of the audio frame being a non-speech frame. The operations may also include determining first decision data based on the first probability data and the second probability data. The first decision data indicates a classification of the audio frame as the speech frame or the non-speech frame. The operations may also include determining second decision data based on the first probability data, the second probability data, and the first decision data. The second decision data may indicate a selection of an encoder to encode the audio frame or a selection of a decoder to decode the audio frame.

In conjunction with the described aspects, an apparatus may include means for determining first probability data associated with a first likelihood of an audio frame being a speech frame. For example, the means for determining the first probability data may include the first classifier 122 of FIGS. 1-3, the speech model 370 of FIG. 3, the encoder selector 760 of FIG. 7, the processor 706 or the processor 710 executing the instructions 756 of FIG. 7, the processor 806 or the transcoder 810 of FIG. 8, one or more other devices configured to determine first probability data associated with a first likelihood of an audio frame being a speech frame, or any combination thereof.

The apparatus may include means for determining second probability data associated with a second likelihood of the audio frame being a non-speech frame. For example, the means for determining the second probability data may include the first classifier 122 of FIGS. 1-3, the music model 372 of FIG. 3, the encoder selector 760 of FIG. 7, the processor 706 or the processor 710 executing the instructions 756 of FIG. 7, the processor 806 or the transcoder 810 of FIG. 8, one or more other devices configured to determine second probability data associated with a second likelihood of an audio frame being a non-speech frame, or any combination thereof.

The apparatus may include means for determining first decision data based on the first probability data and the second probability data, the first decision data including a first indication of a classification of the audio frame as the speech frame or the non-speech frame. For example, the means for determining the first decision data may include the first classifier 122 of FIGS. 1-3, the state machine 374 of FIG. 3, the encoder selector 760 of FIG. 7, the processor 706 or the processor 710 executing the instructions 756 of FIG. 7, the processor 806 or the transcoder 810 of FIG. 8, one or more other devices configured to determine first decision data based on the first probability data and the second probability data, or any combination thereof.

The apparatus may include means for determining second decision data based on the first probability data, the second probability data, and the first decision data, the second decision data includes a second indication of a selection of an encoder to encode the audio frame. For example, the means for determining the second decision data may include the second classifier 124 of FIGS. 1-2 and 4, the long-term decision biasing unit 414, the adjustment parameter generator 416, the classification decision generator 418, the encoder selector 760, the processor 706 or the processor 710 executing the instructions 756 of FIG. 7, the processor 806 or the transcoder 810 of FIG. 8, one or more other devices configured to determine second decision data based on the first probability data, the second probability data, and the first decision data, or any combination thereof. In a particular implementation, the means for determining the first probability data, the means for determining the second probability data, and the means for determining the first decision data are included in the GMM circuitry, as described with reference to FIG. 1.

The means for determining the first probability data, the means for determining the second probability data, the means for determining the first decision data, and the means for determining the second decision data are integrated into an encoder, a set top box, a music player, a video player, an entertainment unit, a navigation device, a communications device, a PDA, a computer, or a combination thereof.

In the aspects of the description described herein, various functions performed by the system 100 of FIG. 1, the example 200 of FIG. 2, the example 300 of FIG. 3, the example 400 of FIG. 3, the device 700 of FIG. 7, the base station 800 of FIG. 8, or a combination thereof, are described as being performed by certain circuitry or components. However, this division of circuitry or components is for illustration only. In an alternate example, a function performed by a particular circuit or components may instead be divided amongst multiple components or modules. Moreover, in an alternate example, two or more circuits or components of FIGS. 1-4, 7, and 8 may be integrated into a single circuit or component. Each circuit or component illustrated in FIGS. 1-4, 7, and 8 may be implemented using hardware (e.g., an ASIC, a DSP, a controller, a FPGA device, etc.), software (e.g., logic, modules, instructions executable by a processor, etc.), or any combination thereof.

Those of skill would further appreciate that the various illustrative logical blocks, configurations, modules, circuits, and algorithm steps described in connection with the examples disclosed herein may be implemented as electronic hardware, computer software executed by a processor, or combinations of both. Various illustrative components, blocks, configurations, modules, circuits, and steps have been described above generally in terms of their functionality. Whether such functionality is implemented as hardware or processor executable instructions depends upon the particular application and design constraints imposed on the overall system. Skilled artisans may implement the described functionality in varying ways for each particular application, such implementation decisions are not to be interpreted as causing a departure from the scope of the present disclosure.

The steps of a method or algorithm described in connection with the examples disclosed herein may be included directly in hardware, in a software module executed by a processor, or in a combination of the two. A software module may reside in random access memory (RAM), flash memory, read-only memory (ROM), programmable read-only memory (PROM), erasable programmable read-only memory (EPROM), electrically erasable programmable read-only memory (EEPROM), registers, hard disk, a removable disk, a compact disc read-only memory (CD-ROM), or any other form of non-transient storage medium known in the art. An exemplary storage medium is coupled to the processor such that the processor may read information from, and write information to, the storage medium. In the alternative, the storage medium may be integral to the processor. The processor and the storage medium may reside in an ASIC. The ASIC may reside in a computing device or a user terminal. In the alternative, the processor and the storage medium may reside as discrete components in a computing device or user terminal.

The previous description of the disclosed examples is provided to enable a person skilled in the art to make or use the disclosed implementations. Various modifications to these examples will be readily apparent to those skilled in the art, and the principles defined herein may be applied to other implementations without departing from the scope of the disclosure. Thus, the present disclosure is not intended to be limited to the e examples shown herein and is to be accorded the widest scope possible consistent with the principles and novel features as defined by the following claims.

What is claimed is:

1. A device for encoding an audio signal, the device comprising:

a first classifier configured to output first decision data that indicates a classification of an audio frame as a speech frame or a non-speech frame, the first decision data determined based on first probability data associated with a first likelihood of the audio frame being the speech frame and based on second probability data associated with a second likelihood of the audio frame being the non-speech frame;

a second classifier coupled to receive the first decision data, the first probability data, and the second probability data from the first classifier, the second classifier configured to output second decision data based on the first probability data, the second probability data, and the first decision data, the second decision data includes an indication of a selection of a particular encoder of multiple encoders available to encode the audio frame; and the particular encoder configured to encode the audio frame responsive to the second decision data indicating the selection of the particular encoder.

2. The device of claim 1, wherein the multiple encoders include a first encoder and a second encoder, and further comprising a switch configured to select the first encoder or the second encoder based on the second decision data.

3. The device of claim 2, wherein the first encoder comprises a speech encoder, and wherein the second encoder comprises a non-speech encoder.

4. The device of claim 3, wherein the second encoder comprises a music encoder.

5. The device of claim 3, wherein the first encoder comprises an algebraic code-excited linear prediction (ACELP) encoder, and wherein the second encoder comprises a transform coded excitation (TCX) encoder.

6. The device of claim 1, wherein the first classifier comprises a Gaussian mixture model module, and wherein the second classifier comprises an open-loop classifier.

7. The device of claim 1, wherein the first classifier includes a state machine, the state machine configured to receive the first probability data and the second probability data and to generate the first decision data based on the first probability data and the second probability data.

8. The device of claim 1, wherein the second classifier includes an adjustment parameter generator configured to generate an adjustment parameter based on the first probability data, the second probability data, and the first decision data, and wherein the second classifier is configured to output the second decision data based further on a value of the adjustment parameter.

9. The device of claim 1, further comprising a switched encoder that is configured to operate in multiple encoding modes, wherein the multiple encoders correspond to the multiple encoding modes of the switched encoder, and wherein the particular encoder corresponds to a particular encoding mode of the switched encoder.

10. The device of claim 1, further comprising the multiple encoders, wherein the first classifier, the second classifier, and the multiple encoders are integrated into a mobile communication device or a base station.

11. The device of claim 1, further comprising:

a receiver configured to receive an audio signal that includes the audio frame;

a demodulator coupled to the receiver, the demodulator configured to demodulate the audio signal;

a processor coupled to the demodulator; and multiple decoders.

12. The device of claim 11, wherein the receiver, the demodulator, the processor, and the multiple decoders are integrated into a mobile communication device.

13. The device of claim 11, wherein the receiver, the demodulator, the processor, and the multiple decoders are integrated into a base station.

14. The device of claim 1, wherein the first classifier is configured to output the first decision data based further on short-term feature data and long-term state data, and wherein the second classifier is configured to output the second decision data based further on the short-term feature data and the long-term state data.

15. A method of selecting an encoder for encoding an audio signal, the method comprising:

receiving, from a first classifier, first probability data and second probability data at a second classifier, the first probability data associated with a first likelihood of an audio frame being a speech frame and the second probability data associated with a second likelihood of the audio frame being a non-speech frame;

receiving first decision data from the first classifier at the second classifier, the first decision data indicating a classification of the audio frame as the speech frame or the non-speech frame;

determining, at the second classifier, second decision data based on the first probability data, the second probability data, and the first decision data, the second decision data indicating a selection of a particular encoder of multiple encoders to encode the audio frame; and providing the second decision data from an output of the second classifier to a switch, wherein the switch selects the particular encoder of the multiple encoders based on the second decision data, and wherein the audio frame is encoded using the particular encoder.

16. The method of claim 15, wherein the first decision data is received at the second classifier from a state machine of the first classifier.

17. The method of claim 15, wherein the multiple encoders include a first encoder and a second encoder, wherein the first encoder comprises a speech encoder, and wherein the second encoder comprises a non-speech encoder.

18. The method of claim 15, further comprising:

determining a first estimated coding gain value associated with a first encoder of the multiple encoders; and determining a second estimated coding gain value associated with a second encoder of the multiple encoders.

19. The method of claim 18, further comprising selecting a value of an adjustment parameter, the value selected based on at least one of the first probability data, the second probability data, long-term state data, or the first decision data, wherein the second decision data is determined based further on the value of the adjustment parameter.

20. The method of claim 19, further comprising adjusting the first estimated coding gain value based on the value of the adjustment parameter, wherein the selection of the particular encoder is based on the adjusted first estimated coding gain value and the second estimated coding gain value.

21. The method of claim 20, wherein the value of the adjustment parameter is selected to bias the selection toward the first encoder associated with speech or the second encoder associated with non-speech.

22. The method of claim 15, further comprising:

determining whether a set of conditions associated with an audio frame is satisfied; and in response to the set of conditions being satisfied, selecting a value of an adjustment parameter to bias the selection toward a first encoder associated with speech.

23. The method of claim 22, further comprising determining whether the audio frame is associated with a sample rate of 12,800 Hertz, wherein the set of conditions is determined to be satisfied at least in part in response to determining that the audio frame is associated with the sample rate of 12,800 Hertz.

24. The method of claim 22, wherein the set of conditions is determined to be satisfied at least in part in response to determining that the first decision data indicates that the audio frame is classified as the speech frame.

25. The method of claim 22, further comprising determining whether a first estimated coding gain value associated with the first encoder being used to encode the audio frame is greater than or equal to a first value, the first value associated with a difference between a second estimated coding gain value and a second value, wherein the set of conditions is determined to be satisfied at least in part in response to determining that the first estimated coding gain value is greater than or equal to the first value.

26. The method of claim 22, further comprising:

determining whether a most recently classified frame is classified as including speech content; and determining whether a first probability value indicated by the first probability data is greater than a second probability value indicated by the second probability data, wherein the set of conditions is determined to be satisfied at least in part in response to determining that the most recently classified frame is classified as including the speech content and in response to determining that the first probability value is greater than the second probability value.

27. The method of claim 22, further comprising:

determining whether each frame corresponding to a number of most recently classified frames is classified as including speech content; and determining whether a first probability value indicated by the first probability data is greater than or equal to a third value, the third value associated with a difference between a second probability value indicated by the second probability data and a fourth value, wherein the set of conditions is determined to be satisfied at least in part in response to determining that each frame corresponding to the number of most recently classified frames is classified as including the speech content and in response to determining that the first probability value is greater than or equal to the third value.

28. The method of claim 22, further comprising:

determining whether a mean voicing value of multiple sub-frames of the audio frame is greater than or equal to a first threshold;

determining whether a non-stationarity value associated with the audio frame is greater than a second threshold; and determining whether an offset value associated with the audio frame is less than a third threshold, wherein the set of conditions is determined to be satisfied at least in part in response to determining that the mean voicing value is greater than or equal to the first threshold, determining that the non-stationarity value is greater than the second threshold, and determining that the offset value is less than the third threshold.

29. The method of claim 15, further comprising:

determining whether a second set of conditions associated with an audio frame is satisfied; and in response to the second set of conditions being satisfied, selecting a value of an adjustment parameter to bias the selection toward a second encoder associated with non-speech.

30. The method of claim 29, further comprising determining whether the audio frame is associated with a sample rate of 12,800 Hertz, wherein the second set of conditions is determined to be satisfied at least in part in response to determining that the audio frame is associated with the sample rate of 12,800 Hertz.

31. The method of claim 29, further comprising determining whether the first decision data indicates the audio frame is classified as the non-speech frame, wherein the second set of conditions is determined to be satisfied at least in part in response to determining that the first decision data indicates the audio frame is classified as the non-speech frame.

32. The method of claim 15, wherein the second classifier is included in a device that comprises a mobile communication device or a base station.

33. An apparatus for encoding an audio signal, the apparatus comprising:

means for determining first probability data associated with a first likelihood of an audio frame being a speech frame;

means for determining second probability data associated with a second likelihood of the audio frame being a non-speech frame;

means for determining first decision data based on the first probability data and the second probability data, the first decision data includes a first indication of a classification of the audio frame as the speech frame or the non-speech frame; and means for receiving the first decision data, the first probability data, and the second probability data and for determining second decision data based on the first probability data, the second probability data, and the first decision data, the second decision data includes a second indication of a selection of means for encoding the audio frame; and the means for encoding the audio frame responsive to the second decision data indicating the selection of the means for encoding.

34. The apparatus of claim 33, wherein the means for determining the first probability data comprises speech model circuitry, wherein the means for determining the second probability data comprises non-speech model circuitry, wherein the means for determining the first decision data comprises a state machine, and wherein the means for determining the second decision data comprises an open-loop classifier.

35. The apparatus of claim 33, wherein the means for determining the first probability data, the means for determining the second probability data, and the means for determining the first decision data are included in Gaussian mixture model circuitry.

36. The apparatus of claim 33, wherein the means for determining the first probability data, the means for determining the second probability data, the means for determining the first decision data, and the means for determining the second decision data are integrated into a mobile communication device or a base station.

37. A computer-readable storage device storing instructions that, when executed by a processor, cause the processor to perform operations comprising:

performing a first operation to generate first probability data associated with a first likelihood of an audio frame being a speech frame;

performing a second operation to generate second probability data associated with a second likelihood of the audio frame being a non-speech frame;

performing a third operation to generate first decision data based on the first probability data and the second probability data, the first decision data indicating a classification of the audio frame as the speech frame or the non-speech frame;

performing a fourth operation to generate second decision data using the first probability data, the second probability data, and the first decision data, the second decision data indicating a selection of an encoder to encode the audio frame; and initiating encoding of the audio frame using the encoder.

38. The computer-readable storage device of claim 37, wherein the instructions further cause the processor to perform the operations comprising:

determining a first estimated coding gain value associated with encoding of the audio frame at a first encoder;

determining a second estimated coding gain value associated with encoding of the audio frame at a second encoder; and adjusting the first estimated coding gain value based on a value of an adjustment parameter, wherein the second decision data is determined based on the adjusted first estimated coding gain value and the second estimated coding gain value.

39. The computer-readable storage device of claim 37, wherein the instructions further cause the processor to perform the operations comprising selecting a value of an adjustment parameter to bias the selection toward a first encoder associated with speech content.

40. A method of selecting a value of an adjustment parameter to bias a selection towards a particular encoder for encoding an audio signal, the method comprising:

receiving first probability data and first decision data from a first classifier at a second classifier, the first probability data associated with a first likelihood of an audio frame being a speech frame, and the first decision data indicating a classification of the audio frame as the speech frame or a non-speech frame;

determining, at the second classifier, whether a set of conditions associated with the audio frame is satisfied, a first condition of the set of conditions is based on the first probability data and a second condition of the set of conditions is based on the first decision data;

responsive to determining the set of conditions is satisfied, selecting a first value of the adjustment parameter to bias a first selection towards a first encoder of multiple encoders; and providing second decision data from an output of the second classifier to a switch, the second decision data determined based on the first value of the adjustment parameter, wherein the switch selects the particular encoder of the multiple encoders based on the second decision data, and wherein the audio frame is encoded using the particular encoder.

41. The method of claim 40, wherein the set of conditions is determined to be satisfied at least in part in response to:

determining that the audio frame is associated with a sample rate of 12,800 Hertz;

determining that the first decision data indicates the classification of the audio frame as the speech frame; and determining that a first estimated coding gain value associated with encoding the audio frame at the first encoder is greater than or equal to a particular value.

42. The method of claim 40, wherein the set of conditions is determined to be satisfied at least in part in response to:

determining that a most recently classified frame is classified as including speech content; and determining that a first probability value indicated by the first probability data is greater than a second probability value indicated by second probability data, the second probability data associated with a second likelihood of the audio frame being the non-speech frame.

43. The method of claim 40, wherein the set of conditions is determined to be satisfied at least in part in response to:

determining that each frame corresponding to a number of most recently classified frames is classified as including speech content; and determining that a first probability value indicated by the first probability data is greater than or equal to a third value, the third value associated with a difference between a second probability value indicated by second probability data and a fourth value, the second probability data associated with a second likelihood of the audio frame being the non-speech frame.

44. The method of claim 40, wherein the set of conditions is determined to be satisfied at least in part in response to:

determining that a mean voicing value of multiple subframes of the audio frame is greater than or equal to a first threshold;

determining that a non-stationarity value associated with the audio frame is greater than a second threshold; and determining that an offset value associated with the audio frame is less than a third threshold.

45. The method of claim 40, further comprising:

determining whether a second set of conditions associated with the audio frame is satisfied; and responsive to determining the second set of conditions is satisfied, updating the adjustment parameter from the first value to a second value to bias a second selection towards a non-speech encoder of the multiple encoders.

46. The method of claim 45, wherein the second set of conditions is determined to be satisfied in response to:

determining that the audio frame is associated with a sample rate of 12,800 Hertz; and determining that the first decision data indicates the classification of the audio frame as the non-speech frame.

47. The method of claim 40, wherein the second classifier is included in a device that comprises a mobile communication device or a base station.

* * * * *